US006843193B1

(12) United States Patent
Alvarez-Calderon F.

(10) Patent No.: US 6,843,193 B1
(45) **Date of Patent: *Jan. 18, 2005**

(54) TRANSONIC HULL AND HYDROFIELD (PART III)

(76) Inventor: Alberto Alvarez-Calderon F., 410 Fern Glen, La Jolla, CA (US) 92037

( * ) Notice: Subject to any disclaimer, the term of this patent is extended or adjusted under 35 U.S.C. 154(b) by 62 days.

This patent is subject to a terminal disclaimer.

(21) Appl. No.: 09/677,897

(22) Filed: Oct. 3, 2000

Related U.S. Application Data

(63) Continuation-in-part of application No. 08/814,418, filed on Mar. 11, 1997, now Pat. No. 6,158,369.

(51) Int. Cl.[7] ..... B63B 1/00
(52) U.S. Cl. ..... 114/56.1; 114/61.3
(58) Field of Search ..... 114/56.1, 63, 61.27, 114/271, 291, 61.29, 61.3, 61.31, 61.32, 126; D12/300, 313, 314; 440/66, 67

(56) References Cited

U.S. PATENT DOCUMENTS

| | | | | | |
|---|---|---|---|---|---|
| 514,835 | A | * | 2/1894 | Mills | 114/56.1 |
| 1,136,306 | A | * | 4/1915 | Beck | 114/126 |
| 1,499,900 | A | * | 7/1924 | Zucker | 114/126 |
| 2,995,104 | A | * | 8/1961 | Mills | 440/66 |
| 4,915,048 | A | * | 4/1990 | Stanford | 114/56 |
| 5,417,597 | A | * | 5/1995 | Levedahl | 440/6 |
| 6,158,369 | A | * | 12/2000 | Calderon | 114/56.1 |

* cited by examiner

*Primary Examiner*—Ed Swinehart
(74) *Attorney, Agent, or Firm*—Adam H. Jacobs

(57) ABSTRACT

A transonic hull having a bow, a stern, a longitudinal length therebetween, side surfaces extending from the bow to outboard portions of the stern, a lower surface extending between the side surfaces, the transonic hull having a submerged volume with an approximately triangular shape in planview with apex adjacent the bow and a base adjacent the stern, and an approximately triangular shape in side view when in motion with a base adjacent the bow and an apex adjacent the stern.

22 Claims, 7 Drawing Sheets

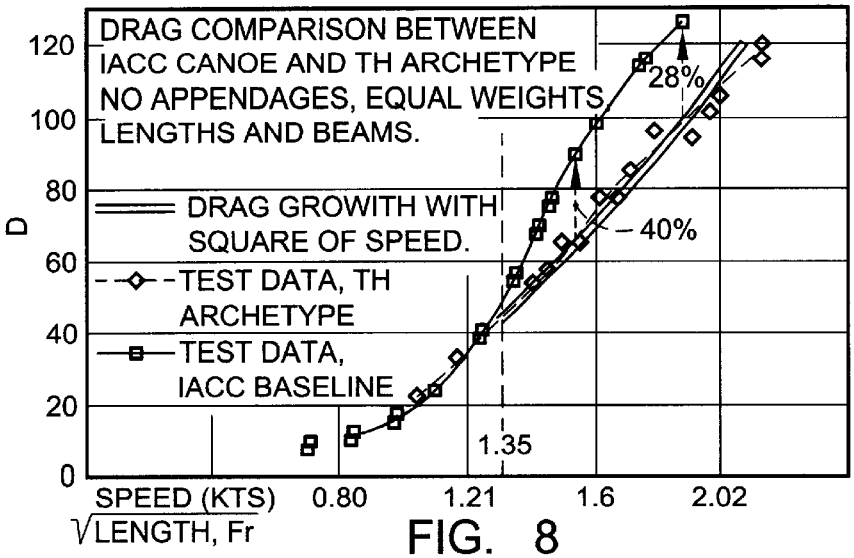
FIG. 8
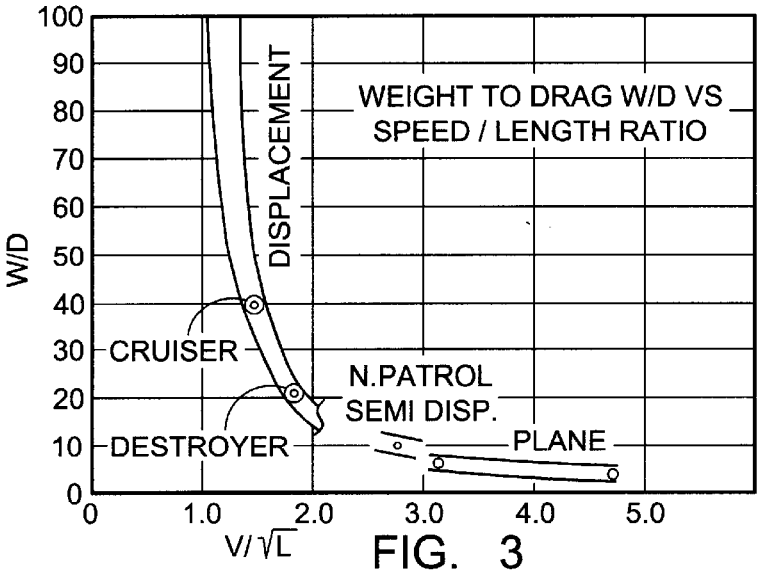
FIG. 3
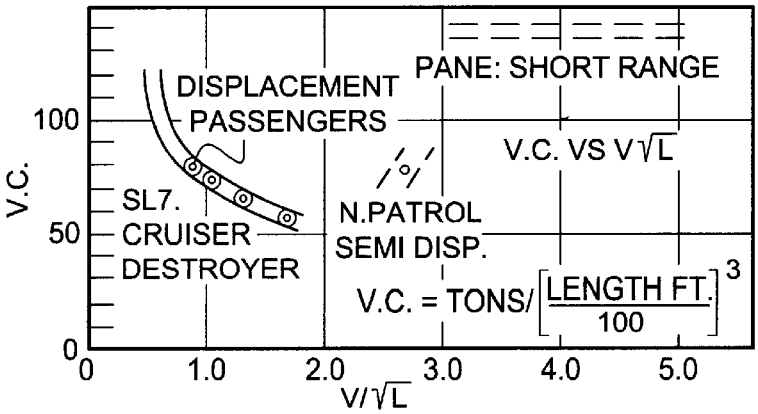
FIG. 4 TYPICAL VOLUMETRIC COEFFICIENTS V.C. AS FUNCTIONS OF SPEED TO LENGTH RATIO V√L $V/\sqrt{L} = 0$ SUPERCRITICAL
$V/\sqrt{L} > 1.25$ $V/\sqrt{L} = 0$ HYPERCRITICAL
$V/\sqrt{L} > 2.0$ TRASPLANAR
$V/\sqrt{L} > 3.0$ $V/\sqrt{L} \geqq 3.0$

TRANSONIC HULL AND HYDROFIELD (PART III)

CROSS-REFERENCE TO RELATED APPLICATION

This application is a CIP of patent application Ser. No. 08/814,418 filed Mar. 11, 1997 now U.S. Pat. No. 6,158,369 which is related to patent application Ser. No. 08/814,417 filed Mar. 11, 1997 now abandoned.

BACKGROUND OF THE INVENTION

1. Technical Field

The present invention pertains to water-supported vessels such as commercial and military ships, submersibles, yachts, hulls for seaplanes operating in and out of surface effects, and boats in general, including operation of such vessels at high speeds in adverse seas.

2. Description of the Prior Art

The art related to the present application covers all the art cited by Examiner in application Ser. Nos. 08/814,418 and 08/814,417, as well as the art cited by the inventor during the prosecution of application Ser. Nos. 08/814,418 and 08/814,417. It may also relate to the art in Jane's *High Speed Marine Craft.*

In addition, the art related to the present application may include the Transonic Hull (TH) and Transonic Hydrofield (TH) specified in patent application Ser. No. 08/814,418, and the propulsion, controls, and shapes of Transonic Hulls specified in patent application Ser. No. 08/814,417.

Although certain vessels having triangular hull planform shape apparently similar in some respect to TH have been proposed in the past (for example, those cited by the Patent Office in the examination of application Ser. No. 08/814,418), these have been designed to have approximately equal drafts adjacent the stern and the bow, as in conventional ship design. The Japanese Patent 61-125981A of Mitsubishi Heavy Industries teaches, in all its embodiments, that the draft at stern and bow of this approximately triangular hull planform are approximately equal and the same as midbody draft. In this they followed earlier design criteria, even as far back as that of U.S. Pat. No. 23,626 of 1859, which also shows equal draft at bow, stern, and midbody. The deep stern drafts with broad beams at the stern are extremely inefficient.

In both the above-mentioned patents, the location of the center of buoyancy (CB) of their hulls, and therefore the location of their centers of gravity (CG) would be, by reason of their planforms and equal drafts, at or very close to their center of planform areas and waterplane, also known as longitudinal center of flotation (LCF), which is at 66% of water line length aft of the bow, unless a bow bulb is used. This proximity of CG, CB, and LCF is usual for conventional hulls. Moreover, such prior art does not consider the effects of CB and CG location on drag under forward motion.

In respect to proximity of CG, CB, and LCF, I have discovered that their proximity as in conventional hulls is not viable for TH, because it renders this type of hull with unstable tendencies in pitch under fast motion, when subjected even to a minor pitch disturbance. Such adverse behavior is similar to a phugoid self-sustained oscillation of aircraft when its center of gravity is close to its neutral point. In a ship, such oscillations not only increase drag, but are undesirable for structures, for cargo and for passengers, and may be dangerous.

Such fundamental problems are serious. The Mitsubishi patent teaches a solution to this problem by means of a bow bulb. Thus, it mixes a bulb technology which was developed and is useful for fat, slow ships, with a different type of hull. This adds drag, as well as volume, to their design, and the drag issue is not priority for prior art.

In contrast, TH and TH of application Ser. No. 08/814,418 make a totally different and innovative solution: it combines, in the submerged portion of TH, a deep draft forward and a shallow draft to the rear, which normal architectural ship design would consider dangerous with an inherent dive potential unless a bow bulb were used. However, following model tests, this writer confirmed that TH theory is correct in that dive tendencies are not determined on a triangular planform. The TH solution renders an inherent distance between LCF and center of buoyancy and therefore has a center of gravity substantially ahead of the LCF. Moreover, the quantitative aspects in the relation between CB, CG, LCF, and stern draft is dependent, I have discovered in relation to lack of dive tendency and established in respect to payload, with reference to the distinctions between the hydrostatic stern condition and the stern's hydrodynamic condition in the supercritical and subcritical regimes, as is done in the present CIP patent application in respect to limits of distances between LCF, CB, CB, and effect on static draft. Furthermore, these key relations are established in the present work in relation to the hydrodynamic drag consequence of entry and exit flow angles in its various speed regimes.

SUMMARY OF THE INVENTION

The present invention specifies new unique design shapes, features, and methods of operation which qualitatively improve and extend the scope of the transonic hull TH and the transonic hydrofield TH inventions of patent application Ser. Nos. 08/814,418 and 08/814,017. The scope of the present invention is summarized below:

1. An extension of the operational speed envelope of TH over a very broad speed range increase by means of new design characteristics and new hydrodynamic regimes beyond the previous subcritical and supercritical regimes in the displacement modes, namely: the hypercritical, the transplanar, and the x-regimes. With these improvements, a single TH hull can operate with good efficiency over a large speed spectrum which otherwise would require two or three ships with different conventional hulls; for example, a conventional displacement ship at lower range of speed and a vee-bottom or semi-planing hull for higher speeds.
2. Another important feature of the invention pertains to hull characteristics and shapes above and below calm-water waterplane which are critical to permit successful operation over the broad speed regime in adverse seas, preferably also in optional combination with special longitudinal distribution of heavy mass components inside the hull, such as engines, fuel, and weapons.
3. A third feature of the invention pertains to special shapes, trim, balance, center of gravity location, location of longitudinal center of flotation, and various kinds of flaps and streaks needed to make feasible and enhance and improve the performance and maneuverability of the transonic hull in calm water and adverse seas.
4. Additionally, other important features of the invention are its hull shapes which have inherent low detectability by radar and other sensors, as well as a wake of low visibility and thermal content, which yields stealth properties to the hull which are nevertheless compatible with efficient hydrodynamics and good behavior in adverse seas.

Thus, the new invention is an all weather stealth transonic hull capable of operating in new high speed hydrofield regimes of the transonic hull, which now includes the hypercritical, transplanar, and X regimes. For simplicity, the hull of the present invention is also referred to in certain important cases as TH-III, and its broadened hydrofield is TH-III. Other embodiments of the present invention are improvements applicable to TH and TH-III.

Because the invention is broad and powerful, it is not necessary to incorporate in a single vessel each and all features and methods of the inventions and improvements, nor is it necessary to incorporate each of them in all claims.

BRIEF DESCRIPTION OF THE DRAWINGS

FIGS. 1, 2, 3 and 4 are examples of the prior art related to this invention; TH, and planview of TH of the present invention;

FIG. 6 is a graph showing the percent distribution of frictional resistance and wave-making resistance as found in the prior art;

FIG. 8 specifies the relation between drag and $V/\sqrt{L}$ for TH and IACC hulls;

DESCRIPTION OF THE PREFERRED EMBODIMENTS

The nature and scope of the present invention can be better understood by reviewing the principal characteristics of conventional hulls, which have certain serious inherent problems in calm water and in an adverse sea, and examining also the limits and potential of transonic hulls TH and their hydrofields in patent application Ser. Nos. 08/814,418 and 08/814,417, all which sets the conceptual inquiry solved by the present invention.

I. Characteristics and Problems of Conventional Hulls.

It is necessary for this review to separate the conventional hull designs by hull types in accordance to their operational speed envelopes. The envelopes are expressed for each hull type in terms of weight-to-drag ratios as function of speed-to-length ratios, best considered together with their corresponding volumetric coefficients, which are indicative of longitudinal surface and volume distributions responsive to their speed envelopes.

1a. Displacement Hulls.

Figure 1:
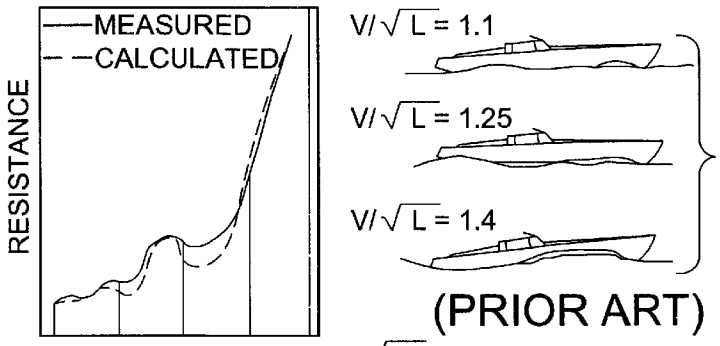
FIG. 1(PRIOR ART) (PRIOR ART)

Displacement hulls sustain boat weight by buoyant lift. As designed in the past and present, they have an upper speed limit called "hull speed," near and above which hydrodynamic resistance (drag) grows at a high exponential rate, for example, as in FIG. 1. The "hull speed" occurs when the length between bow and stern waves generated by and traveling with the translating hull equals the geometric length of the hull. This situation is expressed numerically when the ratio of boat speed in knots divided by square root of boat length in feet equals 1.34.

Displacement hulls are very efficient well below hull speeds with weight-to-drag ratio of over 100. At extremely low speeds, the efficiency ratio increases to much higher values, because drag approaches zero but weight remains constant. However, near or above hull speed, their weight-to-drag ratio decreases rapidly and becomes physically and economically unacceptable. Therefore, higher speeds of displacement hulls is attainable principally by increasing hull length. Unfortunately, the speed advantage of length is not large. For example, the nominal "hull speed" of a 50 foot hull is 9.5 knots, but for 300 foot hull speed, it is only 23 knots.

Figure 2:
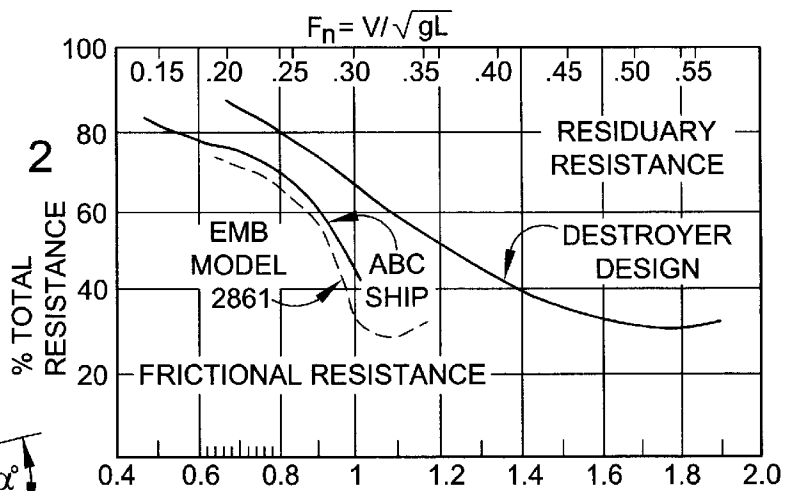

The "hull speed" limit is intrinsic of displacement hulls, because of their wave generation properties as they translate in the water, i.e., "wave making." When the length of waves generated by the hull exceed the geometric length of the hull, as shown in FIG. 2, the situation becomes critical. The increasing size of bow wave with increasing speed induces a further drop of the trough near midbody, leading to incremental sinkage of the hull and an increase of hull's angle of attack. There is also the additional sinkage with speed increase due to the curvature of the hull below local water levels. The increase of angle of attack impedes further speed increase unless very large power is available to climb over the bow wave and enter the planing regime, the limitations of which will be discussed later on.

The high drag due to wave-making adds to and can exceed friction drag, and is a very serious problem in the economics of maritime transportation. Accordingly, considerable research has been done in various ways to overcome it, unfortunately with only minor improvements. For example, a bulbous bow may slightly decrease drag at certain speeds. Also, long slender hulls are less sensitive than beamy hulls, but carry less cargo, and have other problems, as will be reviewed later on.

The principal characteristics of displacement hulls which cause and determine their maximum operational speed envelopes are available in various sources (for example, "A Comparative Evaluation of Novel Ship Types," by MIT's Professor Philip Mandel) and is summarized on the left side of FIGS. 3 and 4. The operational speed envelope covers speed-to-length ratios of 0.8 to about 1.0 or 1.1 for commercial ships, which is well below their "hull speeds" of 1.34. Military ships have speed envelopes that include "hull speed" (for example, a cruiser ship at 1.35) and even above "hull speed" (for example, the slender destroyer operating at speed-to-length ratio of about 1.7). Above the speed ratios described, the required size and weight of conventional power plants and hydrodynamic problems of propulsion at the lower weight-to-drag ratios become unacceptable for the missions of the ships.

Accordingly, there remains an urgent need for improving the high speed efficiency and range of displacement hulls, at least within their current speed limits and preferably in a breakout above those limits. A practical solution is needed, especially if it is able to eliminate wave-making drag of the type which limits conventional hulls, without recourse to conventional hydrodynamic planing.

1b. Planing Hull.

There is a widely held view that a different type of hull, called planing hull, in which weight is supported by a hydrodynamic lift force from momentum change (as distinct from buoyant lift), can overcome the speed limits of displacement hulls, and furthermore that they are efficient at high speed. Actually, while planing permits high boat speed, it does so only for boats with an approximately flat underbody having relatively light weight and equipped with large propulsive thrust. The limiting characteristics of this hull is the presence of dynamic drag due to momentum change, shown in FIG. 5 for the limiting case of inviscid planing. In practice, these hulls operate at angles of attack of 3° to 6°. The inviscid weight-to-drag ratio for optimum flat plate planing case is 19 and 9.5 respectively.

When viscous drag is added to dynamic drag, the fact is that planing is a grossly inefficient hydrodynamic regime, since the best ratio of boat weight to resistance is in the order of 6 to 9, as shown on the right sides of FIGS. 3 and 4. This is less than half that of a modern jet transport flying about 10 times faster, and only 1/10th (or less) that of a displacement hull of "reasonable" length near, but below, hull speed. The operational speed envelope of planing hulls are best exemplified by the ski boats and similar sports craft which below their planing speeds (for example, below a speed-to-length ratio of about 4) require a nose-high attitude with large wave-making drag in displacement mode, a condition similar to that shown for the lowest but longer hull in FIG. 2.

Although the decrease of weight-to-drag ratio with speed in FIG. 3 appears to be continuous with increasing speed-to-length ratio, the left and right sides in FIG. 3 are not continuous, but discontinuous as to shape and type of hulls—displacement and planing—which have discontinuous and widely different volumetric coefficients, as is clearly shown in FIG. 4. Thus, on the left in FIGS. 3 and 4, displacement hulls, if one includes destroyers, cover an operational speed-to-length envelope from about 0.8 to 1.8, in which the weight-to-drag ratio decreases smoothly from over 120 (higher for slow tankers) to about 25, which the corresponding volumetric coefficient decreasing smoothly from about 80 (higher for slow tankers) to about 55 for destroyers. In contrast, on the right sides in FIGS. 3 and 4, planing hulls have an operational speed-to-length ratio of the order of 3 to well above 4 (FIG. 3), but with weight-to-drag ratios of about 6–8, and with a volumetric coefficient of above 100 (FIG. 4), which is evidently much higher than displacement hulls only because the latter are much longer. The higher volumetric coefficient reflects the fact that planing designs are not intended for nor are capable of sustained operation near or below "hull speed" in which their low weight-to-drag ratio would be prohibitive compared to displacement hulls.

As reviewed above, the displacement hull has a wave-making drag component which increases strongly with speed near and above hull speed, in addition to an approximately constant wetted area generating friction drag which increases roughly with square of speed. These drag sources combine into a high total exponential drag growth near and above "hull speed" which was shown in FIG. 1. As a result, operational speed-to-length ratios are about one for commercial ships and somewhat below two for military ships.

The percent distribution of frictional resistance and wave-making resistance, often referred to as residuary resistance because it may include other minor resistance components, is shown in FIG. 6. It shows that above "hull speed" of 1.34 more than 60% of resistance is residuary—mostly wave making drag.

In hydrodynamic contrast, pure planing hulls, having a dynamic lift roughly equal to weight, and a high dynamic drag component dependent on a significant angle of attack required for vertical equilibrium, and hopefully a decreasing friction drag percentage with speed, operate at speed-to-length of order of 3.5 or more, with low weight-to-drag ratio of the order of 8 or less, with operations at lower speed-to-length ratios being an inefficient transient condition, which also have very poor weight-to-drag ratio.

Various hybrid vessels attempting to mix displacement and planing hull characteristics of monohulls have been proposed in the past in an attempt to arrive at a single ship type capable of operating efficiently over speed envelope, unfortunately without much success, as is reviewed below.

1c. Semi-Planing Hulls.

Unlike displacement hulls which have upwardly curved sterns and curvatures at the bow, causing suction which sinks their center of gravity with forward speed (increasing their apparent weight), and unlike planing hulls having mostly flat undersurfaces and a CG which tends to rise with forward speed, the semi-planing hull usually has a Vee bottom and, for practical reasons, is heavier than a pure planing hull. Although the semi-planing hulls can generate the appearance of a "flat" wake at high speeds, their lift is generated by a combination of buoyancy and dynamic forces, which is inherently inefficient. These hybrids are longer and have lower volumetric coefficient compared to those of planing hulls, but are nevertheless much higher than for displacement hulls, as shown, for example, at the middle of FIG. 4.

The borders of the wakes of semi-planing hulls, as seen from an aerial view, appear flat and join together at some distance behind the stern, generating a trailing "hollow" on the water's surface, which can be interpreted, from the viewpoint of a fish trained in hydrodynamics, as an virtual displacement hull of larger length than that of the dynamic waterplane of the operational semi-planing. hull. The conventional semi-planing hull is an inefficient hybrid: at slow speeds, it has excessive drag compared to a good displacement hull. It requires very large power to reach semi-planing speed, at which regime it is not as fast and is less efficient than a pure planing hull. On the other hand, a deep-vee semi-planing hull provides smoother ride for a greater payload in a rough sea, and is more seaworthy than a planing hull. However, it has a rougher ride than a displacement hull, with less favorable sea keeping characteristics, and is commercially not viable for most large maritime applications.

1d. Semi-Displacement Hulls.

As length-to-beam ratio is increased in slender hulls, wave-making drag decreases. According to Saunders, slender displacement power boats were common in the 1910s. Later on, the German Schnell Boote (fast boat), having a round-bottom hull, was successfully developed as an S-boat for WWII, performing well at high speeds in the rough North Sea. However, as the length-beam slenderness ratio of semi-displacement boats is further increased, the lateral stability and payload capacity is further decreased. In the extreme, an 8-man rowing shell relies on oars for lateral stability. With a length-to-beam ratio of about 30, its wave-making resistance is only 5% of the total at 10 knots, but its weight-to-drag ratio is only 20, approximately. An appropriate comparison in aircraft is the modern sailplane with a wing span-to-chord ratio of 25. It can operate at weight-to-drag ratio of 40, at 6 times the speed.

In the limit as the beam of slender hull approaches zero, wave-drag tends towards zero, but viscous drag subsists and payload capacity vanishes. Accordingly, recent development of high speed semi-displacement boats have proposed a mixed lift mode, using complex lateral or other additions to the slender hull, to generate a hydrodynamic lift component at higher speeds, in order to decrease buoyant lift component and its wave-making drag, and to compensate other shortcomings of the slender hull at high speeds, for example, lateral instability and/or a tendency for nose high attitude and its high drag due to lift. As is the case for semi-planing hulls, their speed potential is less than planing hulls, and their ratio of weight-to-drag is not very satisfactory, and in consequence, payload is not large. Although they appear to have performance advantages over semi-planing near or above "hull speeds" and are less sensitive in pitch, their complex shapes appear to have an inherent size limit, as well as a lower speed potential.

1e. Additional Resistance of Monohulls Due In Adverse Sea Conditions.

The various types of monohulls reviewed above have different responses to sea conditions, which sets crucial additional limits to their efficiencies in most practical operations. This is an important subject, since it can and does set crucial limits of operational speed envelopes and impose structural weight and power penalties which are different and significantly more adverse than would be the case for designs of the same hulls operating only for calm water.

In this writer's view, the drag and structural penalties in an adverse sea for displacement and semi-displacement hulls originate in their inherently unfavorable longitudinal distribution of volume and of their buoyancy reserves, which are traditional and perhaps applicable at slower speed envelopes for ships designed to climb waves and which have inadequate speed margins relative to the propagation speed of ocean waves. Moreover, the inertia values of conventional ships would penalize their performance in respect to the higher speed envelopes, if such higher speeds were otherwise attainable with conventional displacement and semi-displacement hulls. Obviously, a breakthrough to decrease the added drag and weight penalties of displacement-related hulls in a sea is highly desirable, particularly if it does not incur into the even worse penalties which planing-related hulls encounter in an adverse sea, such as their well-known "slamming" in an opposing sea. Slamming occurs when quasi-instantaneous, large increases of angle of attack relative to an oncoming wave are encountered, reaching off-design, very large transient angles, which blunt speed and enormously increases the structural loads and weight of the hull.

1f. Multi-Hulls.

The wave-making and other adverse drag problems of the various types of monohulls reviewed above—including added resistance in a sea—are so serious that considerable recent efforts have been applied for the development of new multihulls. Although this field is outside the scope of this document on monohulls, a few remarks are in order. A pair of very narrow slender displacement hulls of a catamaran, widely spaced laterally for stability, have been successfully developed and are being used at high speed for various commercial applications, especially in Asia. The calculation of their volumetric coefficients can be deceptive, since there are two hulls, each with half the weight but of full length. Hence, each hull has a more favorable volumetric coefficient than a monohull, but has two such hulls. Published information on lift-to-drag ratios of modern catamarans are not readily available. Nevertheless, drag estimates based on installed power and operating weight indicate that weight/drag ratios of the order of 10 are feasible for large semi-planing light catamarans at speeds of 50 knots and ratios of 16 for 25 knots, but with very small payloads relative to their overall length and overall weight. These weight/drag ratios are not high and are close to those of planing hulls, but are achieved at higher speeds than for conventional monohull displacement hulls.

Trimarans may have similar characteristics with some structural gains, and they also have large traditional buoyancy reserves forward, but only on the center hull. Recent multihull trends are exploring trimarans with a very long displacement center hull to retain a low speed-to-length ratio of the center hull, with small, narrow, lateral hulls at high speed-to-length ratio for roll stability, and to support a wide deck. Wave-piercing multihulls may have a center body which has water contact only in swells, providing the usual large buoyancy reserves in adverse seas, but permitting wave piercing in middle seas. SWATHS are also multihulls which rely on totally submerged primary displacement for smooth riding, with penalties in wetted area and speed.

These multihull developments and other high speed hull developments (see, for example, Jane's High Speed Marine Craft) have so far been restricted to special commercial or military applications, highlighting the need for ship manufacturers for a new monohull design. Such has been specified in my Transonic Hydrofield TH and Transonic Hull TH invention of patent application Ser. Nos. 08/814,418 and 08/814,417, capable of efficient operation in subcritical and supercritical speeds as defined therein, with drawings in which the water level is shown in calm conditions.

2. Transonic Hull Characteristics, application Ser. Nos. 814,418 and 814,417.

As stated earlier, to understand the nature and scope of present invention, it is also necessary to review, in addition to the problems of conventional hulls, the limits and potential of the transonic hull TH and its hydrofield TH of patent application Ser. Nos. 08/814,418 and 08/814,417, which precede the present Application in filing date, including a review of results of tow tank tests.

2a. Characteristics and Features of TH and TH.

The TH is characterized in having a submerged portion with a triangular waterplane shape with apex forward in static and in dynamic conditions, a triangular profile, or modified triangular profile in side view with maximum draft forward and minimum draft aft, and planar lateral surfaces at large inclination or vertical to the water. Thus, the submerged portion has a double-wedge volume distribution with a fine narrow entry angle in planview and a fine exit angle aft in profile view. Thus, the shape of TH, and its associated hydrofield TH, is characterized in absence of surface wave-making sources such as shoulder, midbody, or quarter curvatures in planview; they have a narrow entry forward which minimizes the water volume displaced per unit of time, and induces special inboard underbody flow, favoring flow subduction which eliminates the conventional wave-making pattern of displacement hulls, and allows for new types of hydrodyamic ray phenomenon of very reduced size and an absence of midbody trough. TH has a favorable anti-planing propulsive pressure component at its undersurface; favorable contracting streamline on the sides; favorable gravitational pressure gradients on the hull's lower surface; broad stern underflow which prevents pitch up and eliminate stern wave, and favors the recovery of underbody energy as well as that from following seas.

Accordingly, a very important feature of TH and TH as specified in my prior patent application Ser. No. 08/814,418 is the elimination of the below-water wave-making sources for high speed operation in calm water within its displacement mode, thus preventing or reducing the high exponential rise of wave-making drag which characterizes conventional hulls near and above their "hull speed." As explained previously, nominal "hull speed" is 1.34 when expressed with speeds in knots divided by square root of boat length in feet. In this speed range, for example as in FIG. 1, the wave drag component of total drag of conventional hulls grows significantly, and hence the total drag grows in a high exponential manner, typically by powers of the order of three or more, depending on hull shape, beam loadings, and Froude number range (Froude number is defined as speed in Ft./Sec. divided by the square root of gravity acceleration times engaged water line length in feet).

Hence, if the principal sources of wave-making drag growth with speed are removed, as is the case of TH and of TH's archetype shape of my patent application Ser. No. 08/814,418, then TH's principal remaining source of drag growth with speed is that due to friction, it being noted that (a) TH has no pressure drag problems at the stern since it has a clean water exit, and (b) TH has greatly reduced form drag, because it has no curved surface to significantly increase local and therefore average dynamic pressure along its wetted surfaces.

Summarizing, it is the objective and feature of TH's archetype that near and above its "hull speed" while in the displacement mode, its total drag grows with only the second power of speed. The displacement operational mode is characterized in patent application Ser. Nos. 08/814,418 and 08/814,417 in its figures related to the supercritical and subcritical speeds. For example, in TH:

The wetted surface remains approximately constant for a given weight;

The water flow on the hull's sides continue as small rays, and the lateral wetted surface remains approximately constant, as is shown in FIGS. 13 and 14 of original application Ser. No. 08/814,418; and The undersurface of the hull has an approximately constant negative angle of attack to the water surface, and actually contributes a forward propulsive pressure force component, which is opposing the retarding pressure components of the water acting on the submerged sides of TH, as is shown in FIG. 13 of original application Ser. No. 08/814,418 and in FIG. 7 of the present Application.

2b. Tank Test Data of TH and TH.

Curves from tow tank test of a TH archetype model (no appendages) are shown in FIG. 8 of the present Application, showing that, in the supercritical regime, which begins at about the speed corresponding to the critical hull speed of a conventional displacement hull, TH's total drag grows substantially with second power of speed above "hull speed," within the speed limits of the test, during which hull's pitch angle had no significant change, and bottom and side wetted surface was observed to have no substantial change. The drag growth to the second power can only occur in the absence of growth of wave-making drag within that speed range. The critical speed of a conventional hull occurs when the length between the bow wave and its corresponding stern wave is equal to hull's waterline length, and this occurs at a ratio of speed in knots to quare root of length in feet of 1.35.

By way of comparison, the drag behavior of a refined International America's Cup Class hull (canoe only; no appendages) tested in same tank at equal length, beam and weight as TH is also shown in FIG. 8, showing substantially equal drag as TH at the critical "hull speed" of a conventional hull, but a drag growth above its "hull speed" greater than the second power and much greater than TH, the IACC hull having experienced also a significant increase of angle of attack with speed.

The test data of FIG. 8 indicates that the IACC hull has 40% more drag than the TH archetype at a speed-to-length ratio of about 1.55, and 28% more drag at a speed-to-length ratio of about 1.75. Due to speed limits of carriage, tests of TH model could not investigate hydrofields at speed/length ratio greater than about 1.8.

The initial design speed to be selected for the square speed growth of TH's total drag depends on TH's shape and on its ratio of boat weight to cube of hull length, and can be lower than the 1.35 shown in FIG. 7, for example, by changing the angle in planview of the sides of TH or changing the weight. For example, a 20% weight reduction lowered the starting speed/length ratio of TH's supercritical speed regime to 1.1, above which drag growth follows only the second power of speed.

2c. Characteristics of TH as to shapes and propulsion.

Patent application Ser. No. 08/814,417 as originally filed included several drawings of critical alternative shapes of the lower surface of TH below water and the shape of TH above water surfaces, which were not shown in Ser. No. 08/814,418, and which are important in relation to the stealth characteristics of the present invention, and of the hull shape of the present invention in relation to TH's ability to negotiate and successfully operate in adverse seas. The review of these previous features and their extension and improvements under the present invention will be made in a later part of the present specification.

3. Conceptual Inquiry on Conventual Hulls Leading To Present Invention.

The above review on the speed envelopes and limiting characteristics of the various types of conventional hulls covered in Sections 1-6 of the present Application, and of the transonic hull covered its Section 7, leads to the following conceptual inquiries, to which the present invention responds.

3a. Considering FIGS. 3 and 4, which shows that three different types of optimized conventional hulls, having well-known hydrodynamic regimes such as displacement, semi-displacement, and planing, are required to operate in calm water in a speed-to-length envelope of less than 1 to greater than 5, is it possible to design a single hull capable of operating in that broad speed envelope?

3b. If the answer to 3a is positive, would one expect that the weight-to-drag ratios of the three types of hull types optimized separately, efficiently, and covering by segments the total breadth of speed-to-length ratios of FIG. 3, could be equaled with a single hull type covering the same total broad speed range, or at least approached over principal segments of the total speed range; or could the weight-to-drag ratio of the new hull decrease, or be improved, at least in part of the broad speed range?

3c. If the single new hull type is established, for example, as in the present TH-III and TH-III invention, capable of operating over the broad speed range currently requiring two or three different hull types, each optimized in over 100 years of development, could that new hull type have penalties in speed and weight in an adverse sea which are larger than the penalties suffered by the three types of hulls optimized also for adverse seas in their respective speed envelopes, or could the penalties for the new hull be less severe, or perhaps mostly eliminated?

3d. Assuming that a revolutionary new hull type achieves the favorable characteristics described in 3a and/or 3b or to 3c above, how should it be trimmed and controlled, and by what methods driven and steered in a calm sea and in an adverse sea?

The above conceptual inquiry is ambitious, and it has been focused and investigated, with the transonic hull TH of patent application Ser. No. 08/814,418 as a starting reference point, as reviewed below.

A reformulation of the conceptual inquiries of 3a to 3c is focused below in more concrete terms:

3e. Is there an upper speed range in which practical operation of TH patent application Ser. No. 08/814,418 in the displacement mode encounters diminishing efficiency returns?

3f. If 3e is the case, qualitative changes or improvements or methods or discoveries needed and feasible for TH and TH of application Ser. No. 08/814,418.

In respect to 3e, the writer first considers the supercritical regime with absence of wave-making drag growth with speed. There has to remain drag growth with speed of viscous origin, imperfectly referred to as friction drag, which for a given hull size grows necessarily with the second power of speed. Hence, there could be encountered practical limits due to powerplant size requirements, weight and costs which occur because power is a cube function of speed growth, even if drag growth of TH is a second power of speed, since power equals drag times velocity.

Figure 7A:
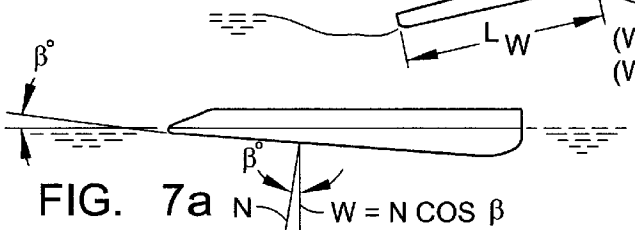
Figure 7B:
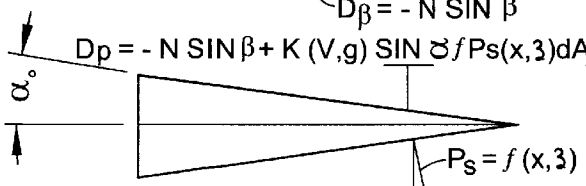

Moreover, there could be a performance limits as speed increases, because TH archetype's propulsive pressure force component in its lower surface shown in FIG. 7*a* is substantially constant, because the hull's weight is substantially constant. Hence, there is a diminishing percentage contribution of the propulsive pressure force $-N \sin \beta$ shown in FIG. 7*a,* compared to overall propulsive needs, which must oppose a friction drag growth responding to the second power of speed.

3g. Diminishing Benefits of TH's Propulsive Pressure Force With Speed Increase

The quasi-constant magnitude of propulsive pressure force component of TH is a problem of significance for TH's overall power requirement, which is illustrated below with a specific example:

Assume a reasonable weight-to-drag ratio of 100 for a 700 foot long TH ship in displacement mode at a speed-to-length ratio of 1.2 with a weight of 30,000 tons. According to FIG. 72, the TH hull of application Ser. No. 08/814,418 experiences in this regime a propulsive pressure force component in its lower surface $-N \sin \beta$. The high weight-to-drag ratio indicates that low total power is required.

The total drag for the example above is evidently 30,000/100=300 tons at a reference speed of $1.2\sqrt{700}=31.75$ knots. The dynamic pressure based on remote speed is 2,879 lb/ft$^2$. The gross propulsive pressure force, GPF, on undersurface is $-N \sin \beta$, according to FIG. 7*a,* where $\beta$ is a negative of the undersurface to remote water. If $\beta$ is $-4°$, the GPF=2,097 tons, canceled in great part by opposing rearward components of pressure forces on sides of TH shown in FIG. 7*b.* Therefore, the net propulsive force NPF on the undersurface is by definition much smaller than GPF, and much smaller than the 300 ton total drag. Assume the NPF opposes 20% of total drag, i.e., 60 tons.

We assume in this example that total drag growth with speed for the TH archetype corresponds to that of an optimum TH hydrofield; namely, drag growth is only that due to friction above "hull speed," and that it increases only with square of speed. This assumption has been verified by test data as shown in FIG. 8 up to a speed-to-length ratio of 2, and is extrapolated beyond that ratio in this example, in order to determine the effects of increase of speed in the relative impotence of propulsive pressure force on the weight-to-friction drag ratio of TH.

If we double the initial speed to 63.5 knots, the drag would be four times, i.e., 1,200 tons, the weight-drag ratio decreases to 50 without accounting for changes in propulsive pressure force, and the speed-to-length ratio increases to $63.5\sqrt{700}=63.5/26.45=2.40$. The corresponding dynamic pressure is 11,516 lb/ft$^2$. However, the NPF, which remains a constant function of weight at constant angle of attached of the hull, is now diminished from 20% to 5% of total drag.

If we triple the speed to 92.25 knots, the drag would go up by a factor of $(92.25/31.75)^2=9$, reaching 2,700 tons, and the weight-drag ratio is lowered substantially to 11.1, with a speed-to-length ratio 92.25/26.45=3.48. The corresponding remote dynamic pressure is 25,911 lb/ft$^2$, and the contribution of NPF becomes negligible percentage of the total propulsive force needed.

If we quadruple speed to 127 knots, the drag would be $(127/31.75)^2$ higher, i.e., 16 times higher, yielding 4,800 tons, and the weight-to-drag ratio would decrease to 30,000/4,800=6.25 at a speed-to-length ratio of $127/\sqrt{700}=4.80$. The remote dynamic pressure is now 46,064 lb/ft$^2$, and the percentile NPF contribution is virtually zero.

The above analysis permits the determination of the following limiting characteristics of the TH archetype of patent application Ser. No. 08/814,418, answering part of the conceptual inquiry of 3a and 3e of the present application:

3h. The friction drag term D for the weight-to-total-drag ratio at higher speed-to-length ratio reaches very high values under enormous remote dynamic pressure q. The viscous drag $D_f$ is governed by the equation $D_f=KC_fqA$, in which A is wetted area, $C_f$ is a viscous coefficient dependent on Reynolds number, and K is a factor to account for form drag and pressure drag. At speeds-to-length ratios of the order of two to four times higher than "hull speed," the weight-to-drag ratio of the assumed TH archetype decreases and could be as low as that of a planing hull, about 8 or less for the example analyzed.

3i. The propulsive pressure force on the lower surface of TH, which is important in the displacement mode near "hull speed" and necessarily a function of the apparent weight of TH and the sine of the negative angle $\beta$ of TH's lower surface, becomes less and less significant as percentage of total propulsive thrust needed to overcome drag as speed increases, since the viscous drag, which total thrust must overcome, continues to grow with the square of speed at constant wetted area, whereas changes of weight with speed, even considering apparent weight increases under subduction flows at high dynamic pressure, and therefore of net propulsive underbody pressure forces, are obviously not as significant.

3j. The subduction flows—for example, flows f in FIG. 14*c* of patent application Ser. No. 08/814,418—consequent of the negative angle of attack of the hull's undersurface, has the potential of increasing the apparent weight of the hull and increasing propulsive pressure force components, but would increase the wetted area of sides of the hull, which is unfavorable.

3k. Benefits of TH With Diminishing Percentile Propulsive Pressure Force.

Notwithstanding the diminishing percent of propulsive pressure force with increasing speed, reviewed under section 3G above, if it were possible to reach high speeds for TH under a displacement mode with reasonable powerplant cost and weight, it would have the very important benefit that even if the weight-to-drag of TH were to be as unfavorable at high speeds as that of a planing hull, TH, unlike planing hulls, has a very favorable weight-to-drag ratio at lower speeds, including the "hull speed" range; and Also, a broad speed envelope with comparable efficiencies could be attainable with a single TH hull instead of two or three types of conventional hulls, provided trim and control were adequate for the TH case, and behavior in an adverse sea acceptable.

3l. Summary of Results of Conceptual Inquiries Above.

The answer to the conceptual inquiry of section 3e is, yes, there are improvements needed in TH and TH of application Ser. No. 08/814,418 to overcome problems of increasing viscous drag with speed (causing diminishing results of propulsive pressure force components). And in respect to inquiry 3d, the answer is also yes, in respect to trim, control, and effect of adverse seas. The solutions to these problems, though difficult in the extreme, has been attained theoretically and experimentally and is covered by the teachings and embodiments of the present invention described in the following section.

4. Objectives of Present Invention The objectives of the TH-III and TH-III invention follow from the need of a solution of the conceptual inquiries, namely:

4a. Establish new hydrodynamic conditions and speed regimes for TH in which weight-to-drag ratio for increasing speed-to-length ratio beyond 2 have improved efficiency.

4b. Achieve objective 5a in a manner that does not deteriorate the favorable results already achieved for TH under application Ser. No. 08/814,418 at speed-to-length ratio below 2.

4c. Consequent to 5a and 5b extend the speed regimes of operation of a single transonic hull TH-III, as may be needed with special shapes, features, powered propulsive means, andvariousdesigndevices,tocover,withacceptableefficiency, a broad speed range normally requiring more than one type of conventional hulls; for example, the speed-to-length range of a conventional efficient displacement hull under 1.35 plus that of a conventional planing hull above 3.

4d. Achieve favorable objectives 5a, 5b and 5c in a manner and with design characteristics that do not deteriorate in presence of adverse seas any more than, and preferably less than, conventional hulls.

4e. Achieves most or all objectives above in a TH-III configuration that is stealthy in respect to radar and other sensing methods.

4f Achieve the above objectives, or a combination of these objectives, with hull shapes, trim features, control devices, and power arrangements that permit favorable operation and maneuvers of TH-III under various sea conditions, including adverse seas and winds, to achieve an all weather operational capability.

5. Substance and Details of the Present Invention.

In order to specify the new speed regimes which extends TH hydrofield to TH-III, and the innovative improvements, refinements, and certain crucial characteristics of TH-III, which have been developed by R&D work of this writer, there is first reviewed the hydrodynamics and speed regimes of TH of application Ser. No. 08/814,418 shown in FIGS. 10 and 11 of the present Application, within the scope of the former application:

5a. Review of Supercritical Regime within TH application Ser. No. 08/814,418.

Figure 10:
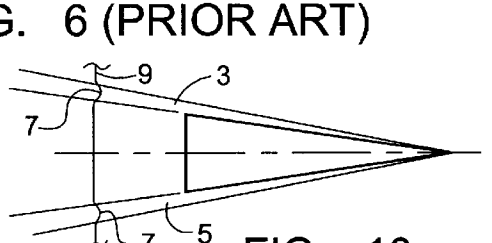
FIGS. 5, 7*a*, 7*b*, 9, 10, 11, 12*a*, 12*b* and 14*f* cover examples shown in previously filed application Ser. No. 08/814,418.

This is the preferred hydrodynamic design condition of the submerged transonic hydrofield for speed-to-length ratio near and above hull speed under application Ser. No. 08/814,418. Its surface appearance is shown in FIG. 10: the surface flow on the wake region is approximately flat and tends on equipotential in the gravitational sense in the region aft of the stern, but it includes molecular agitation, because of friction below the undersurface of TH emerging aft of the stern. Nevertheless, region 1 continues to expand in a unique way, because of its highly directional steady momentum, indicative of successful anti-wave subduction for optimum performance of TH. The flow due to the principal volume displaced by the translating TH emerges principally in region 1, with the minimal surface alteration appearing as left and right three-dimensional rays 3 and 5, having the minimal elevation shown by hump 7 at downstream wake cut 9. This has been observed in tow tank tests up to speed-to-length ratio of 2, which was a tank speed limit.

5b. Review of Subcritical Regime Within Scope of application Ser. No. 08/814,418.

Figure 11:
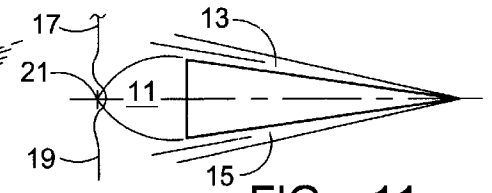

This speed regime is shown in FIG. 11, in which surface flow fields of TH are approximately flat in region 11. But undersurface viscosity forces, relative to momentum content of flow at subcritical speeds, limits the shape and area of the wake at 11 to a gothic arch type with aft border 11. Rays 13 and 15 have larger humps. Downstream of flat wake 11, there is some eddy and hump formations 17 and a central hump 21. In this sub-critical regime, there may be in some cases drag growth with speed higher than second power of speed, because of the eddies and elevations, even though for TH there are no transverse stern wave nor a bow wave of the type of conventional displacement hulls.

In both the supercritical and subcritical speeds, the undersurface of TH in application Ser. No. 08/814,418 is at a substantial negative angle to the remote flow and experience a significant propulsive force.

5c. Development of Hypercritical Regime for TH-III and TH-III.

To achieve operational capabilities of TH beyond the supercritical range tested, new tests were necessary beyond speed/length ratio of 2 to verify the theoretical view that the underbody angle of TH should be governed to change from its initial large negative angle to the surface, towards a much smaller negative angle in order to generate a new hydrodynamic characteristics in which, at constant weight, it was nevertheless estimated that the lateral wetted surface of TH should be greatly decreased in the presence of a decreased flow subduction. This would lead to a more efficient, different 3-D flow behavior with increasing speeds and dynamic pressures, since there was retained, with a decreased lateral wetted area, the following:

A hydrofield and hull without shoulders, midbody or quarter curvatures;

Lack of lateral outward flow and spray.

These characteristics were achieved with new and improved hydrodynamic characteristics in the tow tank, trading off a diminishing percentage of propulsive underbody pressure force, for a significantly reduced drag from reduced lateral wetted surface, resulting in a higher weight-to-drag ratios than otherwise for speed-to-length ratios beyond 2 and of the order of 3. This special different regime is called hypercritical to mark the fact in that (a) no dynamic lift is possible since the undersurface of TH remains at a greatly reduced but still negative angle, but (b) nevertheless there occurs a decrease of lateral wetted surface. The regime is uniquely efficient and to a critical measure a unique property of the special triangular planform of TH, and its profile, under effect of higher levels to achieve the higher dynamic pressure in hypercritical regime, as will be described later on in greater detail with aid of FIG. 13.

5.d Development of the Transplanar Regime for TH-III and TH-III.

In the new model tests, as speed was further increased beyond the hypercritical with the underbody governed to attain a very small and critical positive angle which nevertheless provides significant dynamic lift due to the very the high dynamic pressure acting on a very large wetted planform, i.e., a low planform loading, there resulted a fourth hydrodynamic condition and speed regime, which nevertheless has a substantial decrease of wetted length of the lower surface of the TH-III hull, compared to the hypercritical case. I call this regime "transplanar" in that it retains some lateral in-flow characteristic of the supercritical regime of the transonic hull; that is, the flow direction does not generate the predominantly outward flows typical of planing, which are shown in FIG. 14*f*.

Summarizing, in this writer's R&D on transonic hulls, the operational regimes, which in patent application Ser. No. 08/814,418 were established to cover subcritical and supercritical cases, are now extended and specified to much higher speed ranges, named hypercritical and transplanar, which have weight-to-drag ratios substantially more favorable and require less power than would be the case if the TH of Ser. No. 08/814,418 were powered to achieve, in the displacement mode, the same speed/length ratio range.

5e. The Supercritical Regime as a Preamble to Hypercritical Case.

Figure 12A:
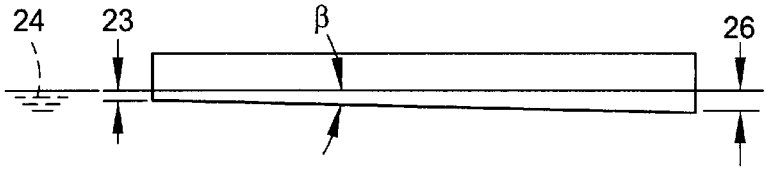

FIG. 12*a* shows, by way of referral, the hydrostatic ($V/\sqrt{L}=O$), waterplane 24 representative of a TH having a length/beam ratio of 4.25 (beam not shown), and stern draft 23 with a draft-to-beam ratio of approximately 0.015 for a weight/length ratio (tons/[length in feet/100]$^3$ of the order to 60. The undersurface has a negative angle $\beta$ establishing a draft at the bow much larger than at the stern.

Figure 12B:
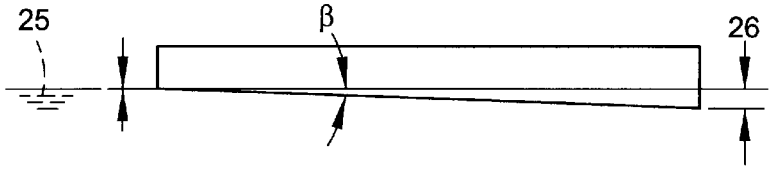

In dynamic condition above "hull speed," the side elevation in respect to remote waterplane of TH in supercritical regime changes to that shown in FIG. 12*b*. Notice that although dynamic stern draft 25 is zero, the undersurface angle $\beta$ and draft at bow as well as deck angle remains substantially unchanged, but propulsive pressure 27 is significant. The corresponding surface of the hydrofield is shown already in FIG. 10.

5f. Specification of (for) TH-III Body and TH-III Flow in Hypercritical Regime

Figure 13A:
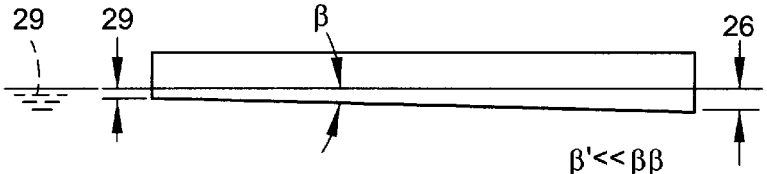
FIGS. 13*a* and 13*b* disclose the TH-III and TH-III in hypercritical regime.

To increase speed beyond speed/length ratio of 2, this writer theorized that the higher momentum content of the wake of TH-III permitted and justified a rearward shift of the center of gravity, shown in FIG. 13*a* as an increase in the hydrostatic ($V/\sqrt{L}=O$) draft 29 with a draft-to-beam ratio of about 0.02, still retaining a deep draft at the bow. However, in the dynamic condition, while the hydrodynamic draft relative to the stern's wake becomes substantially zero in FIG. 13*b*, as in FIG. 12*b*, the undersurface angle is reduced to $\beta^1$ in FIG. 13*b*, substantially smaller than $\beta$ in FIG. 12*b*. $\beta^1$, while negative, can approach zero. This change of angle of attack is not predictable with a bow and shoulder wave of a conventional hull (see FIG. 2), because there is no shoulder wave on TH-III, and its bow wave is minimal. The small angle $\beta$ reduces the total propulsive force, but it was confirmed in new model tests that it reduces also the viscous or friction drag on the sides of TH. While the surface appearance of the corresponding flow appeared as in FIG. 10, it has different three-dimensional flow field components which cannot be related to planing, as no surface component of the hull has positive angle of attack with respect to the remote flow, but nevertheless reduces the wetted area in the sides of TH. The attainment of this condition, in which hydrostatic weight must be substantially equal to displaced water, is altered in respect to FIG. 12*b* by the reduction of apparent weight due to greatly decreased subduction, and a decrease of propulsive pressure force without significant deterioration in surface or wake of the hydrofield. The new regime is named "hypercritical," and was attained with propulsive thrust approximately parallel and below the undersurface located as in prop shaft 33 to provide nose up pitch up couple with respect to TH-III's drag with arm 37 of approximately 0.5 units (0.007% LOA). Alternately, if thrust line is inclined upward as in prop shaft 35, it can provide a lifting force equal to thrust times sine of angle 39. For example, if weight-to-drag ratio were 75, drag would be W/75 and a 10° angle at 39 would result in a lift force of 0.0024 W.

The specifications for FIG. 13*b* differs from and is improved in respect to FIG. 12*b* as follows: large change of angle of undersurface from $\beta$ to $\beta^1$; a large reduction of bow draft from approximately length 26 to a much smaller value 38; a substantial reduction of lateral wetted area and of propulsive pressure on the undersurface, an increase of dynamic pressures and momentum content on the wake, and an aft shift of center of gravity, combined with certain effects of thrust line in this case from propeller but could be water jets as well. The complex combined action of the changes above produce the hypercritical regime and results in greatly improved weight-to-drag ratio for speed/length ratio of order of 3, or more, that is, in the range usually assigned to larger vee-bottom semi-planing boats. Notice, however, that the performance in the hypercritical regime has not impaired the surface appearance of the wake of FIG. 10, but TH-III now operates in three regimes: subcritical, supercritical, and hypercritical, and prevents a wake with a significantly depressed surface.

Figure 13B:
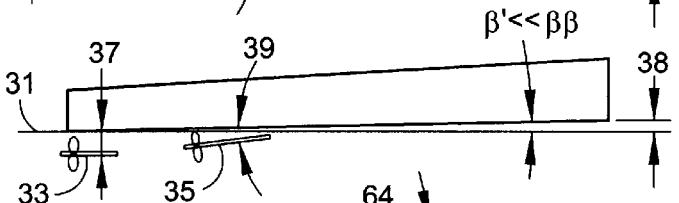

The above description of FIG. 13*b* is feasible for and unique to the TH configuration because its flat sides are devoid of shoulder, mid-body, and quarter curvatures which are usual wave-making sources, and because the maximum beam of TH is adjacent the stern, and therefore collects the entire underbody momentum flows and discharges it in flat exit wake with high momentum content which continues to prevent transverse stern wave formation.

A word of caution in respect to FIG. 13*b* is the limit of center of gravity shift to the rear, since it has to meet both supercritical and hypercritical regimes. Wrong choice can produce a tendency for self-sustained pitch oscillations similar to an aircraft "phugoid" mode, which can become unstable and divergent. The CG location for FIG. 13*b* requires certain limits, reviewed later on.

5g. Specification of TH Body and Flow in Transplanar Regime for TH-III and TH-III.

Figure 5:
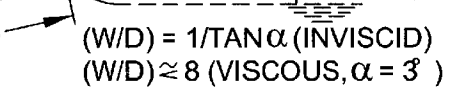
Figure 9:
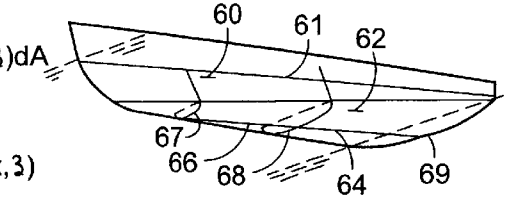

When speed of TH is further increased beyond the hypercritical regime of FIG. 13*b*, an entirely new hydrodynamics was theorized, named herein "transplanar" in that it permits a uniquely efficient partial dynamic lift condition without the type of outward lateral flow which penalizes conventional semi-planing or planing, while retaining the transonic hull features which also yield and permit supercritical, and hypercritical regimes. The hydrodynamics and hull conditions are described with the aid of FIG. 14. Before describing FIG. 14, however, a review is made of conventional planing boat design of advanced design, for example, that of FIG. 14*f*, so that the qualitative differences of the transplanar regime can be appreciated. Conventional planing is characterized as follows:

- A planing hull below the planing speed sinks at the stern, increasing angle of attack due to large bow and shoulder waves as shown on bottom of FIG. 2.
- If the boat's underbody has suitable surfaces and there is sufficient power, the planing boat climbs over its bow and shoulder wave and enters the planing regime of FIG. 14*f*.
- Outward flow 41 in FIG. 14*f* with lateral spray is a consequence of lift requirement by momentum change of conventional planing shapes.
- Minimal planing area Ap shown as 43 in FIG. 14*f* in contact with water provides lift with minimum wetted area, resulting in high area loading, a quotient made by dividing boat weight W by planing area Ap.
- Relatively high planing angle of attack caused by small area Ap; results in high momentum drag component due to lift, as was explained already with the aid of FIG. 5.
- Small planing area Ap, 43, compared to overall area of hull's planform 43+45, results in high slamming loads in an adverse sea on area 45, causing high pitch oscillations, amplified by large hull volume above area 45.
- High beam loading at stern, a quotient obtained by dividing weight W by beam 47, results in a deep wake and high angle of attack.
- A disturbed wake comprising, in cross-section view, hollows 49 and protrusions 51, are symptoms of high momentum drag in addition to lateral flow losses.
- A wake planform that, unless disturbed by propeller slipstream, has a hollow which usually closes downstream of the stern with a large hump 53, a symptom of drag.
- As explained earlier, the large area portion 45 and associated volume above it, which is dry only in calm water but becomes engaged repeatedly in waves, causes high slamming loads plus large change of buoyant forces, leading to excessive cyclic structural loads, severe pitch and heave accelerations which can be intolerable for occupants and cargo, and require slowing the operational speed of conventional planing hulls in adverse sea.

Figure 14B:
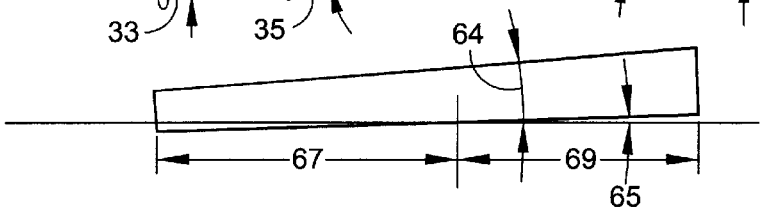
FIGS. 14*a* and 14*b* disclose the TH-III and TH-III in transplanar regime.
Figure 14A:
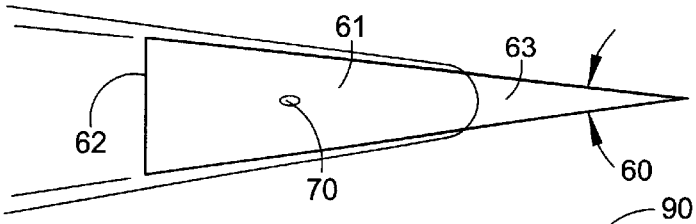
Figure 14D:
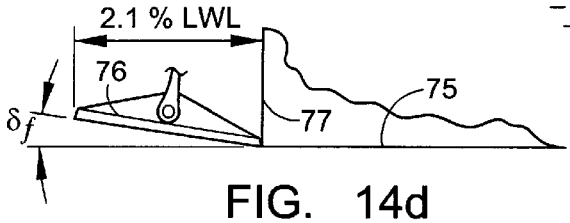
FIGS. 14*c* and 14*d* disclose the stern profile and flap.

Overcoming all of the above problems of conventional planing hulls, TH-III is shown in its transplanar regime in profile in FIG. 14*b* and in planview in FIG. 14*a*. The contrasts and large benefits of TH-III's transplanar regime are evident in the following description:

- There is no shoulder wave on TH over which TH must climb to enter a transplanar regime.
- Large planing area Ap, 61, compared to small dry planform area 63, permits the generation of adequate momentum lift with a small positive angle $\alpha$, which cannot become large because of the location of max beam at stern of TH-III.
- Low transplanar area loading, W/Ap, because Ap 61 is large.
- Inherent low angle of attack $\alpha$ of the hull, feasible for adequate lift with low area loading, W/Ap.
- Low momentum drag with adequate momentum lift, due to inherent small value of $\alpha$.
- Lack of lateral energy dissipating flows from TH-III in the transplanar regime, in favor of typical TH's side rays, not withstanding adequate momentum lift, a unique advantage of the TH-III planform in transplanar flow.
- Low beam loading at stern, achieved by placing a large maximum beam at stern, allowing also low area loading.
- Superior low energy wake achieved with low $\alpha$, low W/Ap; low weight to beam ratio, lack of outward flow, with low energy rays instead, and absence of outward lateral spray flows, as is pointed out in pertinent transplanar claims.
- Excellent behavior in adverse sea because the ratio of dry planform area 63, to wetted planing area 61, and to total area 63+61, is small in smooth seas, whence the dry volume corresponding to area 61 is also small, whereby slamming loads and added buoyant lift in adverse seas produce minimal effects in pitch, thereby avoiding high structural loads and accelerations, as is pointed out in pertinent transplanar claims.

Specifically, FIG. 14*a* shows in planform a transonic hull having its archetype triangular shape, similar to that of FIG. 10 and 11. However, the hydrodynamic regime in FIG. 14*a* is entirely different from FIG. 12, and also different from conventional planing hull. In FIG. 14*b* in the transplanar regime, the hull is at a very small positive angle $\beta^{11}$, shown with numeral 65, with a wetted length 61 and a dry length 69. It is evident that, contrary to a conventional high speed planing hull, the dry area 63 is considerably smaller than area 61, which greatly reduces slamming loads in an adverse sea. Also, volume above length 69 is much smaller than above length 67, reducing added buoyant forces in an adverse sea. In a calm sea, surface of wake shows a unique absence of lateral spray, indeed retaining lateral rays of the type of FIG. 10, which is contrary to, and not possible in, conventional planing hull. These unique features of TH-III's are the subject of pertinent transplanar claims.

Certain critical geometric relations leading to the unique hydrodynamics and superior sea keeping of TH-III, which apply to the hypercritical and transplanar regimes, and the x-regime (see later on), are illustrated in the following example, specified not by way of limitation. In the example, the numerals pertain to FIG. 14, and the numbers identified as units could be feet, tens of feet, meters or other units:

- LWL=LOA=numerals 67+69=70 units
- B, beam numeral 62=16 units
- LWL/B=4.375
- Entry planform angle 60=13 degrees
- Planing length, numeral 67=35 units
- Dry length in FIG. 14, numeral 69=35 units
- Hull's total planform area=560 units squared
- Waterplane area wetted, subcritical, supercritical, hypercritical=560 units squared
- Dry planform forward transplanar, calm water=140 units squared
- Wetted planform transplanar, calm water, 560−140=420 units squared
- % waterplane area loaded hypercritical=100%
- % waterplane area with additional load in adverse seas=0%
- % waterplane area loaded calm water, transplanar, 420/560=75%, transplanar
- % area with transient additional load transplanar in adverse seas=140/560=25%
- Weight of boat=W
- Planform loading=W/420, calm water, transplanar Planform loading=W/560, hypercritical Beam loading all conditions W/16

Average free board height, numeral 64=5 units

Volume above waterplane, transplanar=2100 units cubed

Volume above forward dry planform, transplanar=700 units cubed, partially engaged only in rough water Ratio of volume forward to volume above waterplane 700/2100=0.33

The above design criteria and characteristics of TH, though not limiting, are unique. Moreover, they require, for safe transplanar operation, a proper location of center of gravity (CG), longitudinal center of flotation (LCF), and thrust line, such that the behavior in calm and adverse seas are adequate. The center of gravity needed to meet the required conditions in transplanar flow depend on hull shape in planform, in profile, and thrust line location. A good value for CG location for the above example is 28 units measured forward from the stern, i.e., 40% of LWL, with the thrust line approximately parallel to the undersurface and 1.25 units below it, i.e., 1.78% LWL below it. The above unique features are characteristics for claims.

Figure 14C:
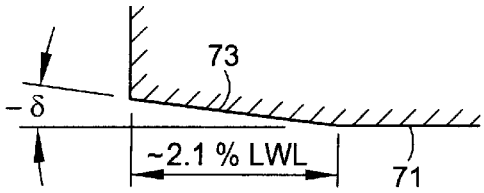

Furthermore, to achieve a transition from hypercritical to transplanar regimes on TH-III with a stable CG, the corresponding aft profile shape is shown as 71 in FIG. 14*c,* for approximately the last 2.0 units of length of the undersurface, shown as 73, having a length of 2.5–3.5% of LWL which should be inclined upwards at approximately −5 degrees, as shown by angle −α. This is qualitatively different and contrary practice to profile shape of high speed planing boats, which recommend opposite upward camber at stern to facilitate planing without excessive angle of attack, and also reduce hump drag before planing; for example, to alleviate nose-up tendency at bottom of FIG. 2.

The critical importance of hull shape, CG, and control flaps to be specified in next sections can be better understood by recognizing the variables involved in pitch equilibrium as hydrodynamic regimes change from zero speed to transplanar in calm water and in a sea. Consideration has to be given to hydrostatic center of buoyancy, hydrodynamic center of buoyancy during hull motion, longitudinal center of flotation (LCF, area centroid of waterplane) which changes radically in transplanar regime, center of dynamic pressure forces due to momentum change, effect of change of hull's angle of attack on hydrodynamic subduction, the respective interaction of all the above in calm water and in an adverse sea.

For example, in the example reviewed above in which the CG is 28 units from stern, i.e., 40% LWL, the center of longitudinal flotation (waterplane area centroid) varies from 23.3 units from stern (33% of LWL) in supercritical regime, to roughly 15 units from stern (21% of LWL) in transplanar regime. Accordingly, the critical distance between CG and LCF vary from (28–23.3) units=4.7 units for supercritical and hypercritical regimes, which is 6.7% LOA, to (28–15) units=13 units, which is 18.5% of LOA, in the transplanar regime. An approximate position is shown as numeral 70 in FIG. 14*a.*

These important parameters and relationships pertaining to longitudinal trim, stability, and control have been exemplified for the transonic hull of the proportions reviewed, with a trailing flap of the type shown in FIG. 14*d* described later on, with the hull having rounded corners between sides and bottom surfaces of radius 1 unit, which is 6.25% of stern's beam.

Variations of the hull's geometry in the example above will alter somewhat the parameters and relations of longitudinal trim, stability, and control. They are also dependent on ratio of weight to volume, for example, weight in tons to cube of length in feet/100. The example given is a guide for ratios in the order of 50 to 85. By way of reference, a ship of 30,000 tons and 750 feet LWL has a weight-to-volume ratio of 71.1. In this respect, it is important to distribute the loading of transonic hull to cause a much greater hydrostatic draft at bow than at stern.

To realize the unusual features of TH and TH-III if flotation with a static waterplane were made such that TH's undersurface were parallel to the waterplane, as is usual for conventional ships, the center of buoyancy would fall at about 33% LOA, requiring the same position of CG, it would cause excessive drag in displacement supercritical regime, and would negate the large distances between CG and LCF of transonic hull in its various regimes, and would cause an unstable pitch situation at higher speeds. Also, TH's stern's wake in supercritical regime would be destroyed. With such parallel flotation, the remedy to move CG forward for pitch stability would require a submerged nose bulb on a transonic hull, which would impair drag and be undesirable in an adverse sea, resulting in slamming loads and large variations of structural bending moments at midbody.

5h. Stern Devices to Make a Single TH Operational in Various Speed Regimes.

To make feasible a flexible and efficient use of the single transonic hull TH over its entire broad speed range—i.e., subcritical, supercritical, hypercritical, and transplanar regimes—variable geometry stern profile is of critical and optimum results, for example, with a trailing edge flap at the stern, but used in a qualitatively different critical and opposite way than stern tabs on conventional planing or semi-planing boats.

FIG. 14*d* shows TH's undersurface with a flat aft profile 75 adjacent stern 77, with a stern flap 76 mounted smoothly at the corner of surfaces 77 and 75, with an upward flap angle Sf of about −6°, and a stern flap chord of 2.5% LWL. This negative angle is needed to generate and govern the critical small angle 65 in FIG. 14*b* in transplanar regime with a stable 40% CG, and in certain cases in subcritical regimes, but not desired in supercritical or hypercritical regimes.

Figure 14E:
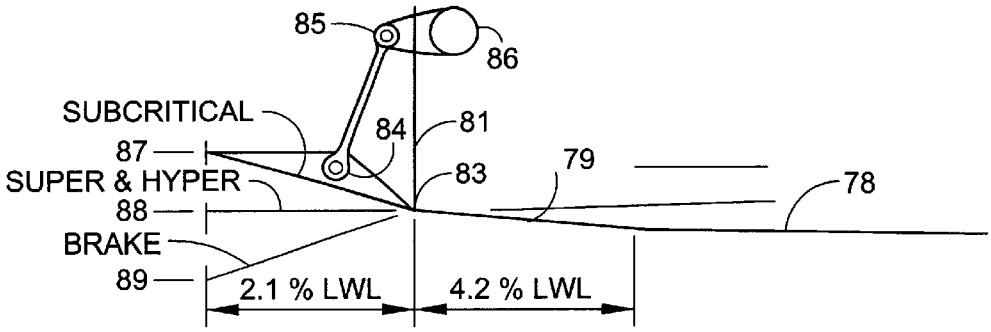
FIG. 14*e* discloses the combination of the stern flap and profile thereof.
Figure 14F:
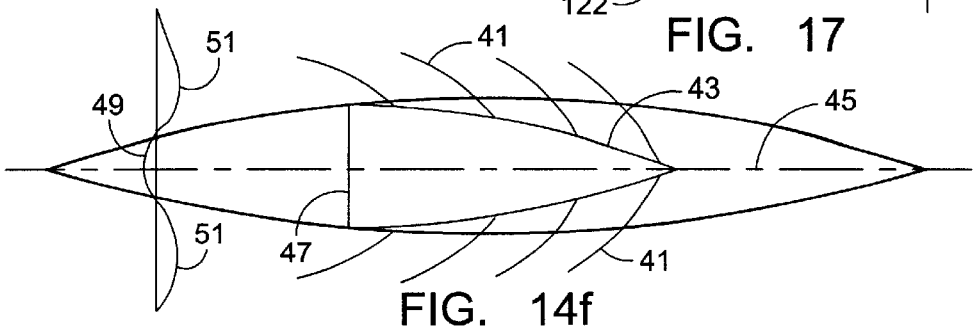

FIG. 14*e* shows the stern flap of FIG. 14*d* installed in the type of stern of FIG. 14*c* modified to accept an optimized hull aft profile. Specifically, there is flat profile aft of hull 78 which curves gently to the rear in sector 79 of 4.2% LOA, thereby reducing stern's draft about 0.18, thereby increasing immersed volume contribution of rear of TH-III, without excessive local stern draft. At corner 83 there is hinged a stern flap 82 of about 2.1% chord operated from torque tube 86 by a connecting rod between arm 85 and bracket 84. The flap has an angle of about −5° for transplanar flow, and optionally for subcritical flow up to about −8°. However, the flap reverses the effect of downwards curvature 79 to about zero exit angle at stern flap position 88 for supercritical and hypercritical regimes, and has a special brake position 89 which buries the bow of TH and raises its stern for a drag increment from both sources, especially beneficial for braking in hypercritical and transplanar speed regimes.

I have reviewed with the aid of FIGS. 12, 13, and 14, the specifications for shape, hydrostatic and hydrodynamics of TH in supercritical, hypercritical, and transplanar regimes, center of gravity and LCF locations and thrust line locations, planform and beam loadings, rear profile shape of TH, stern flap for TH and their combinations, the distribution of dry and wetted undersurface areas and corresponding volumes, and their effects on hull behavior in adverse seas. For the latter case, an increase of weight permits a more aft CG location; for example, for weight-to-length ratio of 76, the CG can be moved back from 0.40 to 0.39, and also at lighter weight-to-length ratio to permit easier entry to the transplanar regime.

5i. Additional X-Speed Regime of TH

Figure 15:
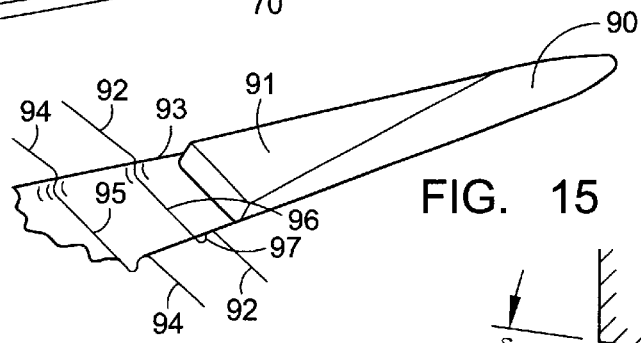
FIG. 15 discloses the TH-III and TH-III in X-regime.

FIG. 15 shows a new regime which has been developed by this writer's R&D on a transonic hull. It is of such a peculiar nature that even its relation to the transonic hydrofield premises and understandings are not entirely explored, although the absence of shoulder, midbody, and quarter curvatures of TH remains critical and most beneficial. But the water-surface conditions appear to defy full understanding, and is therefore identified as the X-regime, encountered in the higher range of speeds, testimony of which are photographs showing the surface conditions specified in FIG. 15 at, around, and to rear of the stern 91 of TH body 90. The wake has a flat even depression with a smooth left edge 93 and a smooth right edge 97 which project rearwards as water extensions of the flat sides of body 90. Wake cross-sections at 96 and 95 show a flat surface of wake below the level of undisturbed flat water-surface areas 92 outboard of depression at 97, and 94 outboard of depression 95. There is no evidence in the wake of rays projecting to rear of transom 91, except as borders of the depressed wake zone. For this x-regime, it is noted, TH has a deeper draft forward as outlined with dash-lines in FIG. 15. The pervasive flat surfaces of the flow field outside the confines of the wake, as well as inside the wake, is evidence of an extraordinary hydrodynamic regime, in which it is possible to postulate a fully lateral flow component in the wake of V sin 4 with V being boat speed and with 4 being half the planform's bow angle.

5j. Roll Control for TH with Stern and Lateral Flaps and Bottom Streaks.

Figure 16:
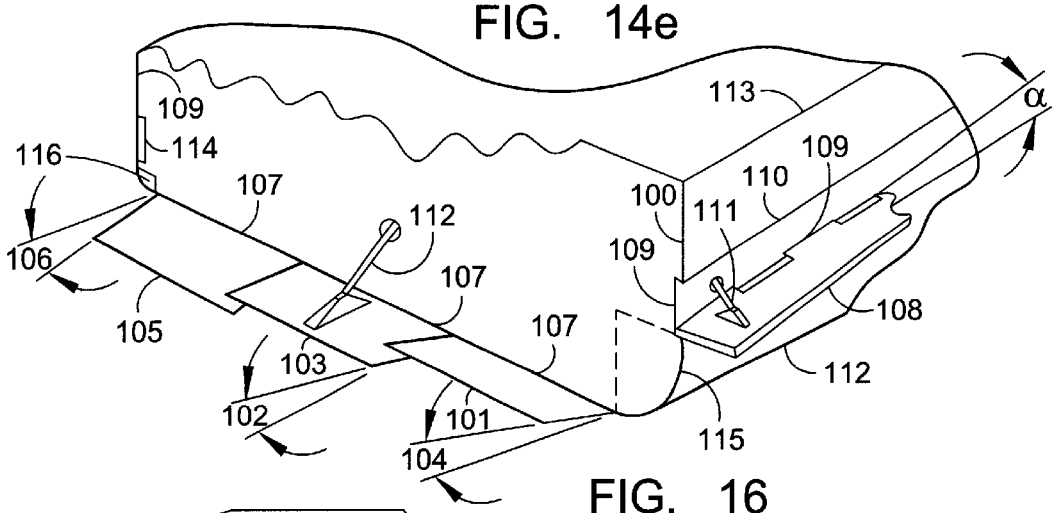
FIG. 16 discloses the stern and side flap for control.

FIG. 16 shows trim and control devices for TH of special value for turns of TH in the hypercritical and transplanar modes. On TH 13, there is wide stern 100 having at its lower edge three stern flap segments hinged at collinear axis 107. The center flap segment 103 acts principally to provide nose-up trim during a turn, and is therefore raised up by angle 102 in respect to a projection of flat lower TH surface 112. The flaps are shown for right turn. Right flap 101 is raised by angle 104 larger than 102, to sink right side of hull 113, and left flap 105 is lowered by angle 106 in opposite direction than angle 104, to raise the left side of TH 113. Accordingly, TH banks to the right and the bottom surface of TH experiences, when yawed to the right under action of conventional rudder, a centripetal force component to the right, which generates a curved path to the right, under Newton's second law. (Rudder not shown in FIG. 16.)

An alternative turning method is shown in FIG. 16, comprising a retractable lateral flap 108 hinged at an axis 109 inclined in profile view to have a positive angle of attack $\alpha$ relative to the flow on the sides of TH. The deployed position of flap 108 shown in FIG. 16 causes an added lift on right side of TH 113, and since the left flap 114 remains retracted, the right side of TH is raised, causing a turn to the left. For rectilinear motion, right flap 108 is retracted by its actuation piston 111 and is nested smoothly in depression 109 on the side of TH.

Another detail of FIG. 16 is the cross-sectional curvature used at the lateral lower corner of the hull. The right side curvature corresponds to a local ellipse sector with major axis vertical and 2:1 ratio used in certain speed regimes of FIG. 14*a* to minimize sinking effects of subduction. A different embodiment is shown at left side with a nearly sharp corner 116, which is best used for x-regime of FIG. 15. As a consequence, the left lateral flap 114 can be placed at a lower position on the sides of TH 113, with more powerful effect.

The mode of usage of stern flaps of FIG. 16 is described in tabular form below in which $\beta$ represents angles relative to the rearward projection of hull's undersurface 112 in degrees.

| Flap position | Left flap | Center flap | Right flap |
|---|---|---|---|
| Subcritical, straight | −4 | −4 | −4 |
| Hypercritical, straight | −5 | −5 | −5 |
| Hypercritical, right turn | +2 | −7 | −10 |

Transplanar and supercritical use of stern flaps for right turns is similar to hypercritical.

The regimes of use of lateral flaps of FIG. 16 are in the supercritical, hypercritical, and transplanar regimes, with a longitudinal length that can be optimized, if desired, for the preferred speed regime, for example, as outlined below.

5k. Lateral Flaps for Hydrodynamic Functions.

Figure 17:
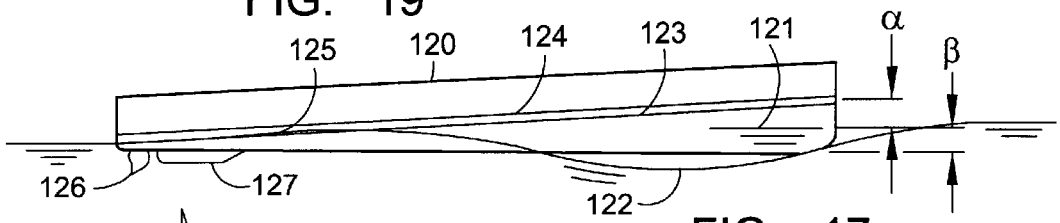
FIG. 17 discloses the TH and TH in sea waves with lateral flaps for control.

FIG. 17 shows lateral devices which have various applications, as follows:

a. Dry deck function: the lateral flaps on TH 120 are deployed when operating in adverse waters, for example, in presence of wave 122, compared to calm water level 121. Under these conditions, a properly designed TH will penetrate the swells with minimal loss of speed, but there may be some water from the swells reaching the top of the freeboard during the penetration. This situation is minimized by right and left lateral flaps 123 forward, 124 at midbody, and 125 aft. The flaps may be similar to flaps 108 in FIG. 16.

b. Pitch control function. In high speed regimes in chopped water or in swells, or even in calm water, selective use of lateral flaps can be used for pitch control; for example, deploying the forward lateral flap pair 123 only for pitch up, or the aft lateral flap pair 125 for nose down pitch of the hull.

c. Lateral control function. Only one flap of midbody flap pair 124 can be used for roll of the hull without pitch effects, or only one flap of pair 125 can be deployed for roll towards the opposite side, which would not have its flaps deployed, and nose down pitch.

d. Heave control. In the high speed range, the deployments of the entire flap set will generate some heave, or the deployment of midbody flap pair 124 will generate midbody heave adjacent CG with minimal pitch effects.

e. Fixed lateral flaps as walking paths: As an alternative (of lower cost), and at some loss of calm water performance, permanent lateral flaps can be used for operation in normal and adverse seas, and also to serve as paths to have crew walk on them in the fore and aft direction for inspection of window seals for forward anchor manipulations forward, etc.

5l. Roll Control with Vertical Undersurface Fences.

FIG. 17 also shows a vertical fence-like surface 127, which can be adapted to be retractable bottom flap for minimum drag in rectilinear motion. When rudder 126 is rotated, it will generate a centrifugal force at the stern, say outward of the paper. This will yaw the stern towards the right. As outward motion is developed, a lateral water flow component inwards towards fence 127 is developed which raises the pressure on the right side of fence 127 and therefore rolls TH right side upwards. The combined action of yaw by the rudder and roll by fence 127 causes the generation of a centripetal force on the hull towards the left, causing a left turn path in accordance to Newton's second law. The centripetal force has two parts: one is the inward component on the bottom of the hull, and the other is the inward force on the right side of the hull. Combined they can generate very tight radius of turn.

5m. Unique Size Effect on Efficiency of Full Size TH Vessels.

My analysis of my tests, I further discovered a very subtle but very important advantage in estimating the weight-to-drag ratio of a TH ship applicable to certain hydrodynamic regimes of TH, as determined in model tests. The advantage is a unique function of size increases for TH's hull, which is not present in the increase of size for conventional hulls. Since the drag growth with speed of TH in displacement supercritical, hypercritical, and hydrofield regimes is principally of viscous origin and wave-making phenomena or drag of momentum change is much less significant over these speed ranges compared to conventional displacement or planing hulls in the same speed range, TH's weight-to-drag ratio improves with increasing size for various reasons; one important reason is that viscous drag decreases strongly with Reynolds number as size increase at constant Froude number. For example, if drag coefficient with increasing scale from model to ship decreases 50%, and if, for simplicity, the viscous drag were estimated with the cube of the scale, it would be diminished by 50%, but the wave-making drag and the weight would be calculated with the cube of the scale. Moreover, since a wetted area increases with the square of the scale, there would be a further reduction of viscous drag. The practical consequences of TH's reduction of wave-making drag in displacement mode in model tests is that the W/D ratio of a TH ship predicted from model tests can be estimated to be 20% or more than that predicted from model tests of a conventional displacement ship at same speed, size, and weight.

5n. TH Shapes for Solving General Problems in Adverse Seas.

Ships and displacement boats have been designed in the past and present with substantial buoyancy reserves, and these are larger from about midbody up to the bow, which reserves are transiently engaged in adverse seas, to raise the ship's bow when encountering waves. Even displacement ships such as destroyers having a sharp entry at the bow at waterplane level and narrow waterplanes are nevertheless flared outwards and forward above waterplane to provide buoyancy reserves, as well as permit open decks forward protected from adverse seas by fences above deck level.

Monohulls with vee bottoms and planing boats also have substantial buoyancy reserves and planing type surface reserves from midbody to the bow, for the same purposes.

It has also been the practice of conventional ships and boats to place heavy components amid-ships, to reduce pitch inertia.

The TH design departs from, and is contrary to, these traditional monohull approaches in respect to shapes and volumes for adverse seas, with several important departing TH design features, exemplified in FIGS. 18*a* to 18*g*.

Figures 18A, 18B, 18C, 18D, 18E, 18F:
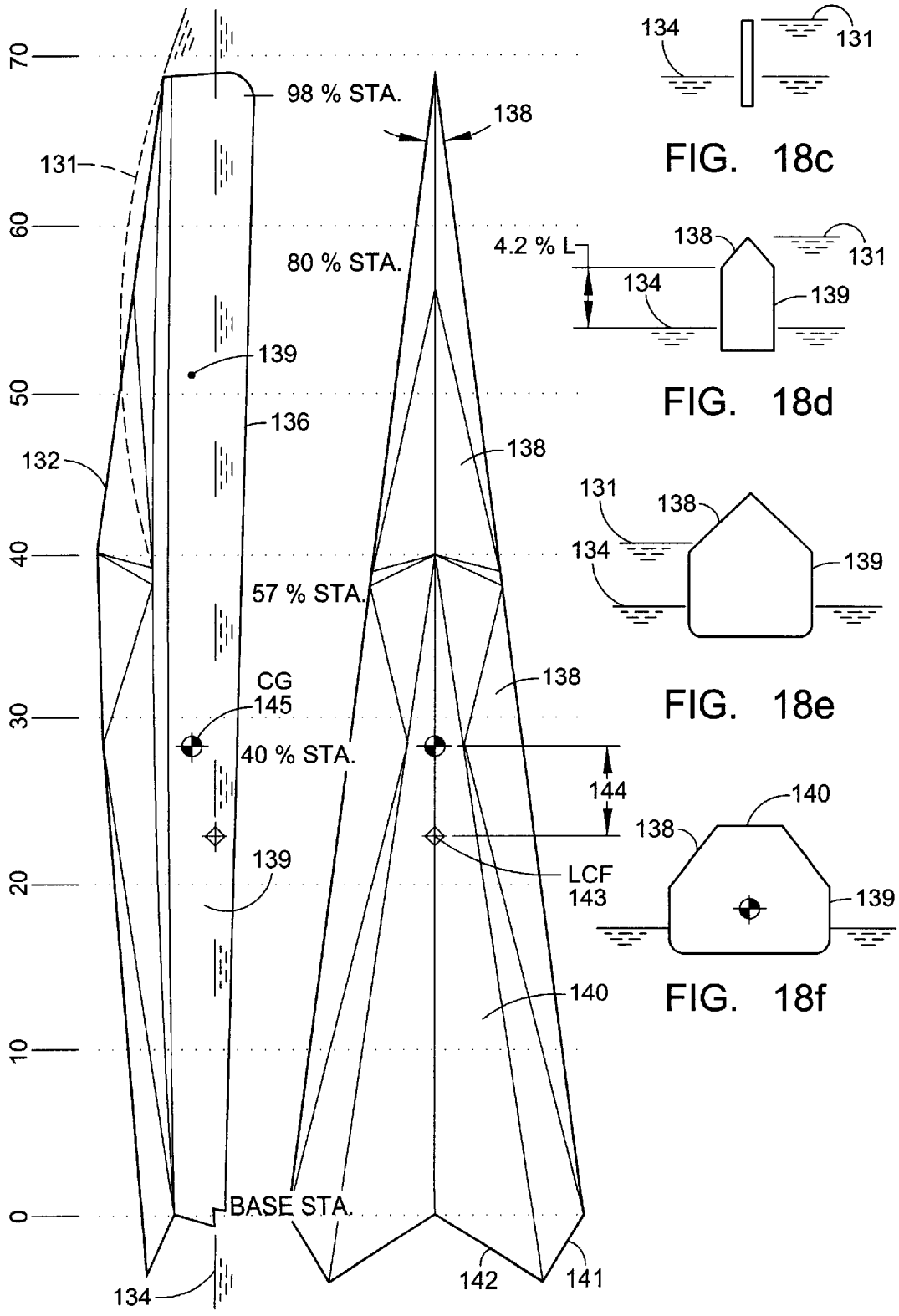
FIGS. 18*a*–*f* disclose the TH 3-D shape for operation in adverse seas and stealth operation.

FIG. 18*a* shows planview 130 of TH with a length of 70 units and max beam aft of 16 units. FIG. 18*b* shows side view contour 132 above static water 134; and submerged profile line 136. FIGS. 18*c* to 18*g* show cross-sections of TH-III. The following unique features are noted:

A very sharp total entry angle in planform into waves at all levels above and below waterplane as shown in FIG. 18*a,* and confirmed by cross-section 18*c,* 18*d,* 18*e.*

A reduced free-board and profile height above static waterplane in the forward third of hull as shown in FIG. 18*b.*

A greatly reduced volume in forward region of the hull above static waterplane, evident in the transverse cross-section FIGS. 18*c* to 18*f.*

A traverse cross-sectional shape distribution above static waterplane in the forward region of the hull that has falling shoulders or an inverted vee shape to dissipate vertical loads from waves being pierced, as shown in FIGS. 18*c* to 18*f.*

An enclosed habitable volume in the forward portion of the hull to permit piercing of waves as shown in FIGS. 18*c* to 18*f,* instead of conventional designs taking in water on top of an open forward deck.

The specific shapes of TH-III successfully tested in adverse seas are shown in FIG. 18 reviewed above, characterized further in the following:

In FIG. 18*a,* an entry angle extending to the sides of hull below and above waterplane at total angle 138 of approximately 13°, over the entire length of the hull Low profile with vertical freeboard forward of approximately 4.2% of the length of hull at 80% station from stern, as in FIGS. 18*b* and 18*d*

Cross-section of hull above waterplane with inverted vee as in FIGS. 18*d* and *e,* or inverted U as in FIG. 18*f,* with a smooth low overall profile with a maximum height above waterplane of approximately 7% of overall length.

A critical parameter is the resulting volume of buoyancy reserve in the forward region of the hull above calm waterplane 134 which can be displaced as a transient condition, for example, during a transient diving encounter into a large wave, such as wave 131 in FIG. 18*b.* This additional volume should be related to the water volume displaced by the weight of the ship in calm water. Successful tests of TH-III have been made with volume ratios in the order of 13% for the additional volume between 80% station and bow in FIG. 18*b,* and on the order of 32% for the additional volume between station 57% and station 80%, with a hull's center of gravity at approximately 40% station. These ratios were obtained by graphic estimates which are necessarily rough in nature, and can be refined by computerized calculations with software having wave simulation, although the latter criteria is incomplete because the asymmetry of the forward aft area of waterplane. These ratios result in minimum heave and pitch disturbances.

Referring bag to the TH-III planform and profile in FIG. 18, it is very important and critical to clarify that the dynamic loading at high speeds of the hull, for example, under action of wave 131, is considerably smaller than conventional very slender boats, such as that shown in *Sea Horse* publication of November 1994, for the following reasons:

At high speed, TH-III has near-zero or a very small angle of attack such as in FIGS. 13 and 14, and therefore the change of vertical momentum of TH-III is much smaller than with very slender hulls having dynamic lift assist and which at speed tend to ride nose high with a large portion of the hull's dry area and volume exposed to wave's impact and therefore capable of generating very large loads.

Furthermore, the planview of TH-III is much sharper for a given hull beam, because it is triangular with max beam at stern, rather than with lenticular sides with max beam near midship, as is shown in other U.S. patents.

Thus, for a given profile, the volume of buoyancy reserves of TH-III is less in forward region.

Cross-section forward has an inverted vee shape to prevent extremely high local loads under dynamic water impact when piercing a wave or from waves breaking on top of the hull such as would be in the case if, instead of having an inverted vee, there would be an inverted cup.

Figure 19:
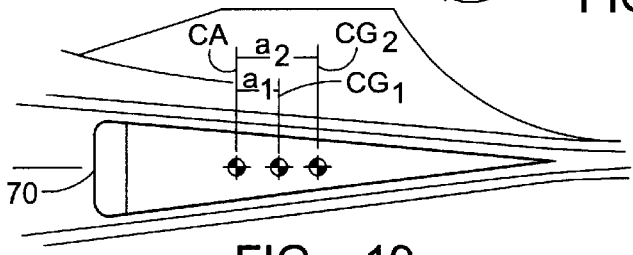
FIGS. 19–28*c* disclose further embodiments and structures associated with the TH and TH of the present invention.

With TH-III geometric properties, it becomes especially advantageous to distribute the heavy components of the ship to maximize the longitudinal moment of inertia, i.e., that about a transverse axis through the center of gravity at 40% station in FIG. 18*b,* and an alternative one through the longitudinal center of flotation at 33% of station in FIG. 18*a* and b, although the latter criteria is incomplete because of he asymmetry of the fore and aft areas of waterplane. Placing powerplant, heavy weapons, fuel tanks, and other heavy areas adjacent bow and stern are important. The model tests have shown very favorable results with as much as 40% of the total boat weight assigned near the hull's ends. This may necessitate, in certain cases, the unusual powerplant distribution shown in FIG. 19.

5o. Weight distribution of TH-III.

Figure 19A:
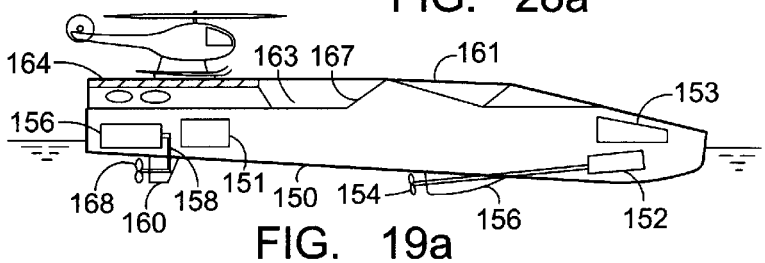
Figure 19B:
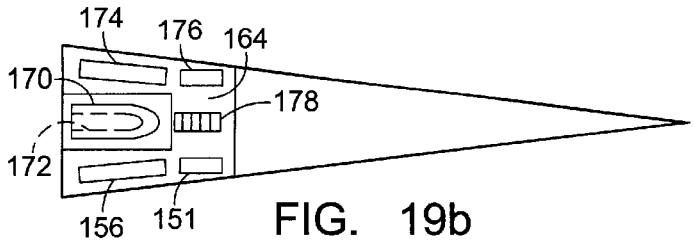

FIG. 19*a* shows in side view a TH-III 150 having a forwardly located engine 152 driving a midbody propeller 154 driven through a conventional shaft, both protected by vertical fin 156 which can also provide good tracking and centripetal forces in a yaw. At the rear are a pair of left and right engines, only one of which is shown as engine 156. It drives a vertical shaft 158 which is submerged in rudder 160 to drive propeller 168 mounted on the rudder, or separate and ahead of the rudder. The power plant system can comprise therefore three engines. Fuel tanks 151 and 153 are also located at extremes of the hull, so that heavy components maximize pitch inertia of the hull. The upper part 161 of hull 150 is similar to that of FIG. 18 in the forward half, but in the aft half there is an open deck having two additional features which combine uniquely with the broad stern beam: one is a helicopter landing pad 164 above deck. Another is a stern garage 170 in FIG. 19*b* for launching and retrieving an auxiliary powerboat 172, while the TH-III ship is in motion. FIG. 19*b* also shows how to fit right engine 156 and tank 151 on right side of garage with left engine 174 with left tank 176 on left of garage, and stairway 178 out of garage. All of which is uniquely possible by max beam at stern.

5p. Stealth and Low Observable Characteristics of TH-III

Returning to FIG. 18, I now describe the stealth anti-radar surface arrangement of Th above waterplane 134. Specifically, the envelope of the hull follows a faceted criteria of low radar signature, which I review on the right side of the hull, having flat panels shown in the cross-sectional views 18*c* to 18*g,* comprising flat panels 138 inclined at about 45° to the waterplane, flat panel 139 inclined at about 90° to the waterplane and top flat panel 140. Thus, directly from above the hull presents only three panels: 138 left and 138 right, both inclined at 45°, and flat panel 140, approximately horizontal. From an oblique side view from above on right, there are only three significant panels: 138 right, 139, and 140. From the front view, by its nature, the TH-III shape is extremely stealthy. From the rear, it's detectability is limited to four dispersing oblique surfaces: 141 and 142 on the right, and corresponding pair on the left, without numerals.

5q. Center of Gravity and Waterplane Centroid of TH-III

Other important details in FIG. 18 is the center of gravity 145 CG location at 40% of hull length from stern, and the longitudinal center of flotation 143 LCF at 33% of length from stern, really a waterplane centroid, providing thereby a dynamic stabilizing arm between CG and LCF of 40%−33%=7% of boat length in displacement mode, as already mentioned for other figures and which is a radically larger number than possible for conventional displacement ships, and is uniquely feasible with, and advantageous for, TH-III. In the transplanar mode, this margin is increased substantially above 7%, and can reach the order of 14% in reference to transplanar LCF 143TP.

5r. Undersurface Shape and Construction Methods for TH-III

As specified in original patent application Ser. No. 08/814,417, modern construction methods using composite, or stamped metal sheet and/or welded plates can be used for TH-III; also wood can be utilized.

However, TH-III can be designed for low cost fabrication methods, taking advantage of its unique simplicity of shape, especially with the use of prefabricated composite sheets, marine plywood or sheet metal, which can be used in flat elements, and/or with gentle single curvature panels, to obtain hydrodynamically smooth surfaces.

Original patent application Ser. No. 08/814,417 also specified FIGS. 20*a,* 20*b,* 21, 22, 23, 24, 25, 26 and 27, without change (except sequential numerals and minor grammatical corrections).

Figure 20A:
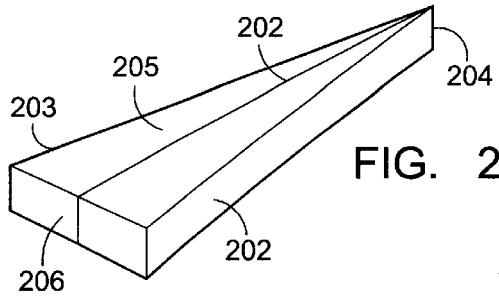

FIG. 20*a* shows an isometric bottom view of TH-III comprising flat rectangular lateral sides 200 and 203, converging at bow 204 in triangular planform; a flat triangular bottom 205, with centerline 202; and a flat stern region 206. This shape, with a wetted triangular profile, as reviewed earlier, transcends wave-making drag of conventional hulls, but may have excessive wetted area and viscous drag.

Figure 20B:
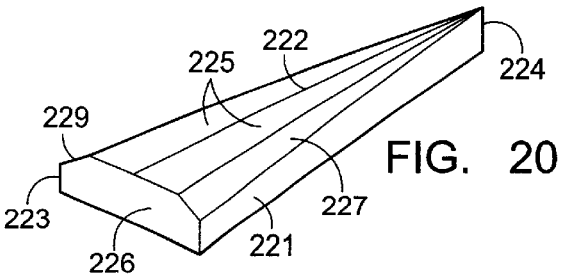

FIG. 20*b* shows TH-III refined with simple construction methods to reduce viscous drag by introducing additional triangular flat panels at the undersurfaces of the hull, modified to have a hull with flat trapezoidal sides 221 and 223 converging at bow 224. The undersurface comprises three triangular flats 229 at left, 225 at middle with centerline 222, and 227 at right. The triangles terminate in flat stern region 226.

Figure 21:
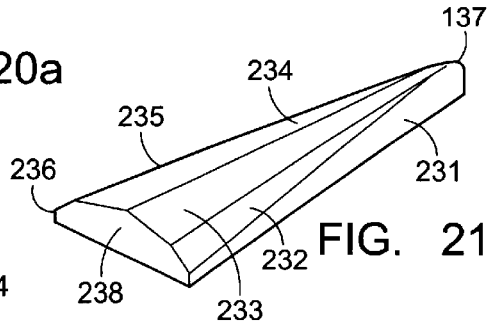

FIG. 21 shows a pure triangle surface development of TH-III in which its sides and undersurfaces of the hull are defined by triangular flat surface elements 231, 232, 233, 234, 235, and 236 converging at bow 237 and terminating at stern region 238.

Figure 22:
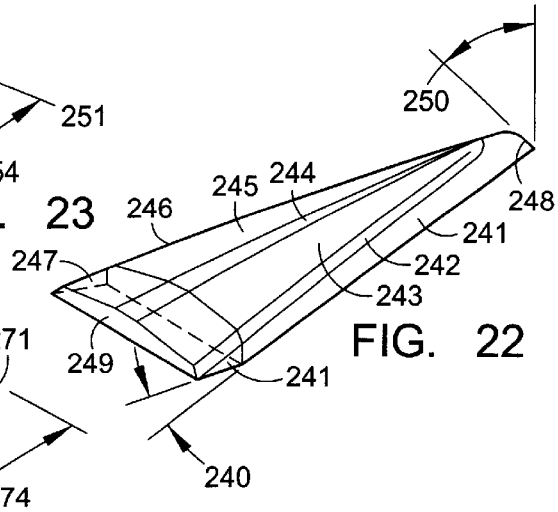
Figure 24:
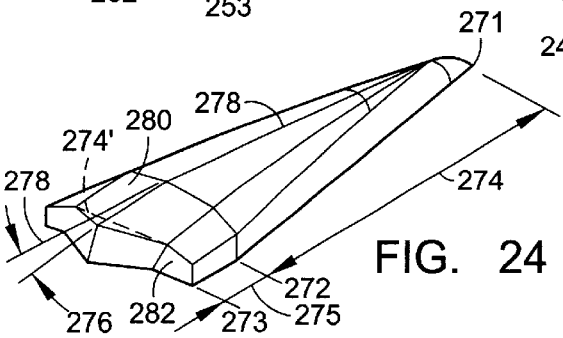
Figure 25A:
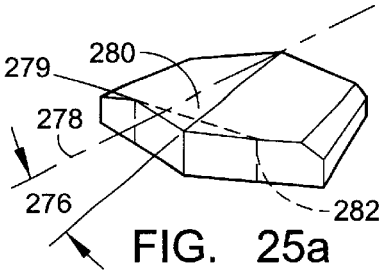
Figure 25B:
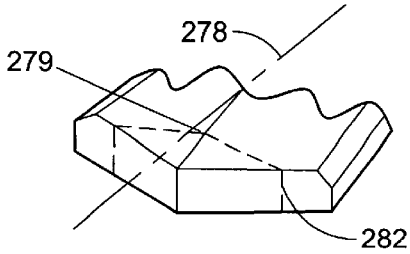
Figure 26:
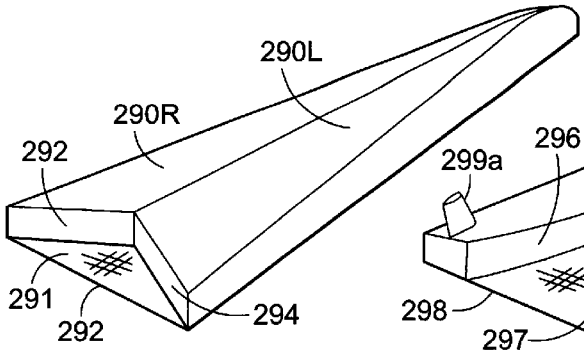
Figure 27:
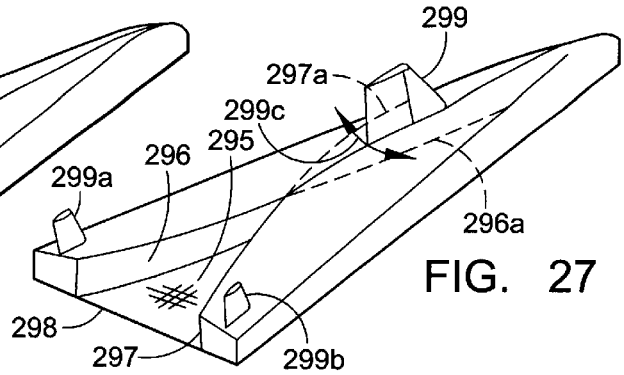
Figure 28:
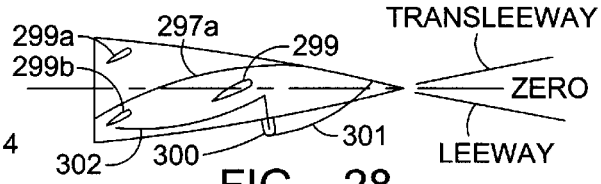
Figure 28B:
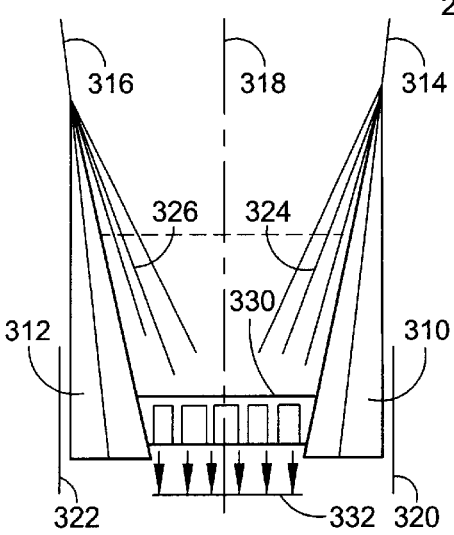
Figure 28A:
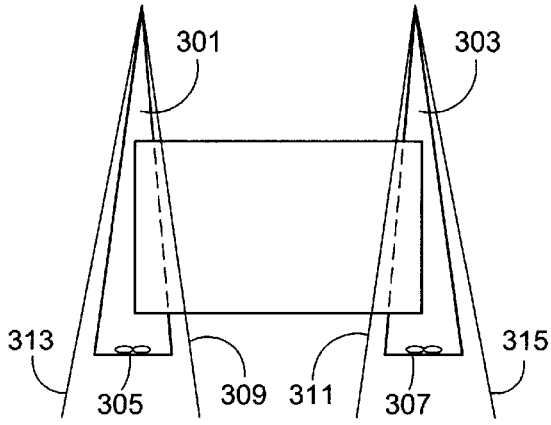
Figure 28C:
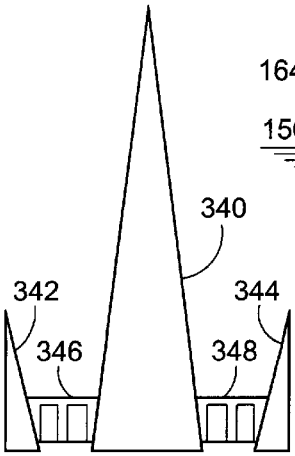

FIG. 22 shows a shape developed from FIG. 21, but more refined to further reduce viscous drag. Its undersurface and side surfaces comprise main quasi-triangular surfaces 241, 243, 245 and 247, between some of which there are trapezoidal or triangular fairing strips 242, 244 and 246, all of which blend in bow 248, now extending at an angle 250 to the vertical to reduce the rate of volume engagement per unit of time as function of draft. Surfaces 242, 243, 244, 245 and 246 extend rearwardly towards a flat transom 249 of little depth, shown vertical only for clarity of drawing. The upper deck surface adjacent to the transom is now at an angle 240 to the forward deck surface, defining a rearward sub-triangular termination to side surfaces 241. For ease of construction, in FIG. 22 elements 242–246, and even 244, could be rectangles of very high aspect ratio, the principal gain being lower cost of fabrication.

Figure 23:
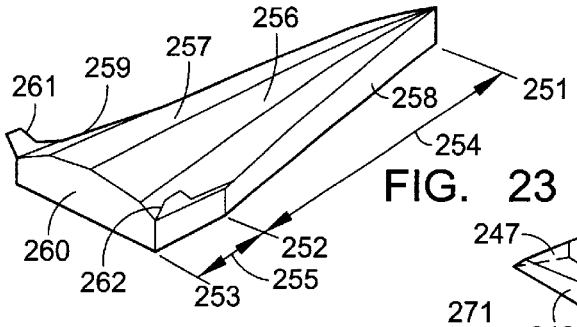

FIG. 23 shows a variation of TH-III, in which, when there are practical restrictions to hull length and/or hull beam (such as design rules, or available dock length for docking, or maximum beam for trailering purposes, all of which may impact on water length and/or righting moments for a given displacement). It may be necessary to modify the TH-III archetype of FIG. 19. For example, hull shape shown in FIG. 20 meets greater displacement for a given maximum beam with a modified quasi-triangular arrangement for a given maximum beam.

Specifically, in FIG. 23 the main component of the hull comprises a main triangular body of length 254 extending between bow 251 and the triangle's base station 252 in the manner shown in previous figures. But, in FIG. 23 the hull is now extended aft with an aft body of length 255, extending between triangle's base station 252 and sten region 253. Note that although the extension is quasi rectangular in planform at deck level along 255, the submerged undersurface remains flat with main triangular surface components 256 and 257, and flat near triangular surface components 258 and 259, extending to transom 260.

A special feature for TH-III shown in FIG. 23 is the use of vertical or anhedraled winglets 261 and 262 at the rear and of the hull, to extract energy from the fan-like submerged flow field along surfaces 258 and 259, thereby increasing the hull's effective beam at transom 260, without increasing its geometric trailerable beam for the case of vertical winglets. If these winglets are inclined by an ahedral angle as on the left side of FIG. 23, they can begin to act as rear hydrofoils supporting part of the weight otherwise supported by hull extension 255, and they can also serve for directional control.

It is noted that in FIGS. 20 to 23 the submerged undersurface have been flat or nearly flat, guided by surface elements and hydrodynamic waterplanes having triangular features, with decreasing draft and increasing beam as the water moves towards the rear, setting a favorable gravitational hydrostatic pressure gradient for the flow which remains active in hydrodynamic condition.

The development of shapes using flat surface components reduces fabrication costs and helps illustrate design features. Penalties are small by reason of unique cooperation between the simple shapes of the TH-III archetype permitting use of flat and/or single curvature elements to attain a reasonably smooth double wedge TH-III body.

The numerical values of the design criteria mentioned above are representative for the hull characteristics reviewed, and may be adjusted for specific TH-III hull shapes with full size weights, corresponding thrust line positions, and other design features within the spirit of the invention and its claims.

The specifications and drawings pertain to hydrodynamics and TH-III shapes and does not cover structural details of mechanisms, and because model tests are not sufficient for determining stability of full size manned TH-III of unknown weight, or other safety related matter, these matters should be investigated and determined solely by licensed manufacturers, who have the sole responsibility in such matters.

Changes can be made on the drawings and specifications without departing from the teachings as covered in the claims of the invention.

I claim:

1. A transonic hull having a bow, a stern, a longitudinal length therebetween, side surfaces extending from said bow to outboard portions of said stern, a lower surface extending between said side surfaces, said transonic hull having a submerged volume with an approximately triangular shape in planview with apex adjacent said bow and a base adjacent said stern, and an approximately triangular shape in side view when in motion with a base adjacent said bow and an apex adjacent said stern.

2. The transonic hull of claim 1 further characterized in that the hydrodynamic regimes during said motion include a supercritical regime with a speed to length ratio greater than approximately 1.35, a hypercritical regime with a speed to length ratio greater than approximately 2.0 and a transplanar regime with a speed to length ratio of greater than approximately 3.0.

3. The transonic hull of claim 1 wherein the weight-to-displacement ratio is within a range having an upper value of approximately 100 and a lower value of approximately 50.

4. The transonic hull of claim 1 further characterized in that said lower surface in side view has a principal length extending from a first station adjacent said bow to a second station upstream of said stern, and a trim-inducing segment length extending from said second station rearwardly towards the bottom of said stern, with said segment length having a local beam approximately equal to the beam of a base adjacent said stern, with the lower surface on said trim inducing segment length being inclined upwardly and to the rear of said principal length by a small negative angle, whereby a downwardly force adjacent said stern tends to raise the bow of said hull when in motion in the hypercritical and transplanar hydrodynamic regimes.

5. The transonic hull of claim 4 in which said small angle is approximately 5°.

6. The transonic hull of claim 4 in which the angle between said principal length and the water surface is approximately 2° with the bow deeper than the stern when operating in said hypercritical hydrodynamic regime, and in that said small negative angle of said segment length is approximately 4° relative to said principal length.

7. The transonic hull of claim 1 in which a trailing flap is provided at the bottom of said stern with an overall athwartship flap beam approximately equal to the beam of said base adjacent said stern and a flap chord approximately equal to 2.5% of said longitudinal length of said hull.

8. The transonic hull of claim 7 in which said trailing flap is set at a first angle approximately parallel to said lower surface in said supercritical regime, is reset at second angle inclined upward with respect to said first angle when in said hypercritical regime, and reset at a third angle inclined upward with respect to said second angle in said transplanar regime.

9. The transonic hull of claim 1 in which said hull when floating in water without motion has a waterplane area with a center of gravity located at approximately 40% of the length of said waterplane measured from said stern, and a centroid of waterplane area located at approximately 33% of said length of said waterplane, measured from said stern.

10. The transonic hull of claim 2, in which a trailing flap is provided on the lower edge of said transom and is set at a first angle inclined downwardly by a small amount in respect to said trim inducing segment length in said supercritical speed, and is reset to be approximately parallel to said segment in said hypercritical regime, and is reset to be inclined at a small negative angle relative to said segment in said transplanar regime.

11. The transonic hull of claim 1 being characterized in having a shallow stern draft in static conditions, and having propulsive means capable of imparting propulsive forces to generate forward motion to said hull to at least two speed regimes to thereby develop in dynamic conditions different types of hydrofields with corresponding different levels of hydrodynamic efficiencies, including a supercritical regime in which:

said propulsive means imparts a first propulsive force by which said hull reaches a supercritical speed;

by virtue of said speed, the draft at said stern relative to the supercritical dynamic water level below said stern is substantially eliminated;

with the deep draft of said bow, relative to its adjacent supercritical dynamic water level being approximately the same as said deep draft in said static condition;

with the hull's supercritical dynamic waterplane remaining with an approximately triangular shape;

with the wetted side surface area and lower wetted surface area in said supercritical regime remaining approximately the same as in said static condition;

with substantial portion of said lower surface retaining approximately the same negative angle with respect to the supercritical dynamic water level as in said static condition; and with said principal portion of said lower surface in said dynamic condition experiencing a substantial upward pressure force having a forwardly oriented force component which pushes said hull forward cooperating with said propulsive means in imparting said forward motion in said supercritical regime resulting in a first level of hydrodynamic efficiency.

12. The transonic hull of claim 11 further characterized in that said hydrofields include a hypercritical regime faster than said supercritical regime and in which:

said propulsive means impart a second propulsive force higher than said first propulsive force;

with the draft of said hull in said hypercritical regime adjacent said bow, and the wetted area of the side surfaces of said hull being substantially reduced relative to that in said supercritical regime;

with the hull's dynamic waterplane shape in said hypercritical regime remaining substantially the same as in said supercritical regime;

with the stern draft of the lower surface in said hypercritical regime remaining substantially unchanged as in said supercritical regime;

with the angle between said substantial portion of said lower surface and said dynamic waterplane in said hypercritical regime remaining negative but substantially reduced relative to said negative angle in said supercritical conditions;

with the forwardly pressure component on said bottom surface being substantially reduced; and with the combined effects of the above specified conditions yielding an efficient hypercritical regime faster than said supercritical regime.

13. The transonic hull of claim 12 further characterized in that said hull achieves an efficient transplanar regime and in which:

said propulsive means impart a third propulsive force higher than said second propulsive force;

with the draft of said hull adjacent said bow being eliminated and with a lower portion of said bow being raised above the dynamic water level in said transplanar regime;

with the hull's dynamic waterplane being changed in said transplanar regime to an approximately polygonal shape having at lest four sides, with substantially symmetric right and left sides, an athwarship side located adjacent said stern, and a shorter side adjacent said bow;

with the stern draft of said rear portion of said lower surface in said transplanar regime remaining substantially the same as in said hypercritical regime;

with the wetted side surface in said transplanar regime being reduced with respect to said hypercritical regime;

with the wetted area of the lower surface of said hull in said transplanar regime being substantially reduced relative to that in said hypercritical regime;

with the angle between a major portion of said lower surface and the dynamic water level in said transplanar regime being a small positive angle smaller than said negative angle;

with the pressure component on said wetted lower surface being rearwardly oriented; and with the combined effects specified above yielding an efficient transplanar regime faster than said hypercritical regime.

14. A transonic hull having a submerged portion with a bow, a stern, and a length therebetween, said submerged portion being characterized in having:

an approximately triangular waterplane at water level with an apex adjacent said bow and a base adjacent said stern;

an approximately triangular profile in side view when in motion with apex adjacent said stern and a deep draft adjacent said bow; and a downwardly facing surface having right and left triangular longitudinal surface elements with their bases adjacent said stern and their apex adjacent said bow.

15. The transonic hull of claim 14 further characterized in having a third central triangular longitudinal surface element with base adjacent said stern, said third element being located between said right and left elements.

16. The transonic hull of claim 14 further characterized in having longitudinal right and left side surface elements, and in having right and left elongated polygonal longitudinal elements extending between and connecting said side surface element with the corresponding right and left triangular elements of said downwardly facing surface of said submerged portion of said hull.

17. An all-weather transonic hull having a bow, a stern, and a length therebetween, a static waterplane at water level when floating without motion in calm water, with said hull having:

an approximately triangular shape in said static waterplane with apex adjacent said bow and a base adjacent said stern;

side surfaces extending from said bow to the outer portions of said stern;

lower surfaces extending between the lower regions of said side surfaces;

an upper surface portion extending between at least the forward portion of the upper regions of said side surfaces;

with said upper surface portion, the portion of said bottom surface below said upper surface portion, and the side surface portions therebetween enclosing therein a forward hull volume;

with said forward volume having an upper volume portion above said static waterplane and a lower volume portion below said static waterplane; and an entry angle of said static waterplane adjacent said bow is approximately 13° with a free board no higher than approximately 4.2% of the length of the hull forward of the 80% station of the hull measured from said stern.

18. The hull of claim 17, further characterized in that the volume enclosed by said hull above said waterplane between the 50% and 80% longitudinal stations measured from the stern forward is no greater than approximately 40% of the volume of said hull which is below static waterplane, whereby the pitch and heave characteristics of said hull in an adverse sea are further enhanced.

19. The transonic hull of claim 17 further characterized in that:

the portion of said hull below said static waterplane envelopes a first volume of displaced water; and in that the volume enclosed by said hull above said waterplane forward of the 80% longitudinal station measured forwardly from the stern being no greater than approximately 20% of said first volume, whereby the penetration against sea waves and pitch characteristics of said hull in an adverse sea are favorable.

20. The transonic hull of claim 17 further characterized in that the heavy components of said hull including powered propulsion engine means to move said hull and fuel tank means are located adjacent to one of said stern and said bow and away from the midbody region of said hull, whereby the pitch and yaw inertia of said hull are increased, and the pitch and control characteristics of said hull in an adverse sea are enhanced.

21. An all-weather transonic hull having a bow, a stern, and a length therebetween, a static waterplane at water level when floating without motion in calm water, with said hull having:

an approximately triangular shape in said static waterplane with apex adjacent said bow and a base adjacent said stern;

side surfaces extending from said bow to the outer portions of said stern;

lower surfaces extending between the lower regions of said side surfaces;

an upper surface portion extending between at least the forward portion of the upper regions of said side surfaces;

with said upper surface portion, the portion of said bottom surface below said upper surface portion, and the side surface portions therebetween enclosing therein a forward hull volume;

with said forward volume having an upper volume portion above said static waterplane and a lower volume portion below said static waterplane; and the ratio of the volume of said upper volume portion to said lower volume portion being no greater than approximately 2.8.

22. The structure of claim 21, further characterized in that the ratio of said upper volume portion to said lower volume portion decreases forwardly of the 80% station measured from said stern.

* * * * *